US010690082B2

(12) United States Patent
Dudar

(10) Patent No.: US 10,690,082 B2
(45) Date of Patent: Jun. 23, 2020

(54) SYSTEMS AND METHODS FOR INTELLIGENT EVAPORATIVE EMISSIONS SYSTEM DIAGNOSTICS

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/148,713

(22) Filed: Oct. 1, 2018

(65) Prior Publication Data

US 2020/0102904 A1 Apr. 2, 2020

(51) Int. Cl.

| | |
|---|---|
| ***F02D 41/22*** | (2006.01) |
| ***F02M 25/08*** | (2006.01) |
| ***F02D 41/00*** | (2006.01) |
| ***F02M 35/10*** | (2006.01) |

(52) U.S. Cl.

CPC ..... *F02D 41/22* (2013.01); *F02D 41/004* (2013.01); *F02M 25/089* (2013.01); *F02M 35/10229* (2013.01); *F02D 2041/224* (2013.01); *F02D 2200/50* (2013.01)

(58) Field of Classification Search

CPC .. F02D 41/22; F02D 41/004; F02D 2041/224; F02D 2200/50; F02M 35/10229; F02M 65/006; F02M 25/089; G01M 3/025

See application file for complete search history.

(56) References Cited

U.S. PATENT DOCUMENTS

| | | | | |
|---|---|---|---|---|
| 8,036,788 | B2 | 10/2011 | Breed | |
| 9,523,317 | B1 | 12/2016 | Li | |
| 9,630,611 | B1 * | 4/2017 | Dufford | B60W 10/06 |
| 9,797,348 | B2 | 10/2017 | Dudar | |
| 9,890,744 | B2 | 2/2018 | Li | |
| 2014/0277927 | A1 * | 9/2014 | Guo | F02M 25/0818 701/34.4 |
| 2016/0040630 | A1 | 2/2016 | Li | |
| 2017/0114744 | A1 * | 4/2017 | Martin | F02M 25/0818 |

(Continued)

OTHER PUBLICATIONS

Korosec, K., "Audis Can Now Talk to Traffic Lights," Fortune Website, Available Online at http://fortune.com/2016/12/06/audi-traffic-lights-vegas/, Dec. 6, 2016, 2 pages.

(Continued)

*Primary Examiner* — George C Jin

(74) *Attorney, Agent, or Firm* — Geoffrey Brumbaugh; McCoy Russell LLP

(57) ABSTRACT

Methods and systems are provided for determining whether there is a source of undesired evaporative emissions stemming from a fuel system and/or an evaporative emissions system of a vehicle. In one example, a method includes initiating an evacuation of the fuel system and the evaporative emissions system to conduct an evaporative emissions test diagnostic, in response to a status of a traffic light that the vehicle is approaching. In this way, the fuel system and the evaporative emissions system are evacuated prior to the vehicle coming to a stop, and then a pressure bleed-up portion of the test is conducted while the vehicle is stopped at the traffic light.

19 Claims, 7 Drawing Sheets

(56) References Cited

U.S. PATENT DOCUMENTS

| | | | | |
|---|---|---|---|---|
| 2017/0342931 | A1* | 11/2017 | Dudar | F02D 41/222 |
| 2017/0363055 | A1 | 12/2017 | Dudar et al. | |
| 2018/0283233 | A1* | 10/2018 | Kachi | F01L 1/3442 |
| 2019/0108693 | A1* | 4/2019 | Dudar | B60K 15/03177 |

OTHER PUBLICATIONS

"Cars and Traffic Signals to Communicate at Smart City Setting," iHLS Website, Available Online at https://i-hls.com/archives/82223, Mar. 29, 2018, 2 pages.

* cited by examiner

SYSTEMS AND METHODS FOR INTELLIGENT EVAPORATIVE EMISSIONS SYSTEM DIAGNOSTICS

FIELD

The present description relates generally to methods and systems for conducting an evaporative emissions test diagnostic on a vehicle evaporative emissions system as a function of traffic light status.

BACKGROUND/SUMMARY

Vehicle evaporative emissions control systems may be configured to store fuel vapors from fuel tank refueling and diurnal engine operations, and then purge the stored vapors during a subsequent engine operation. The fuel vapors may be stored in a fuel vapor canister, for example. In an effort to meet stringent federal emissions regulations, emission control systems may need to be intermittently diagnosed for the presence of sources of undesired evaporative emissions that could release fuel vapors to the atmosphere.

One method of testing for the presence of undesired evaporative emissions in an emission control system may include applying a vacuum to a fuel system and/or evaporative emissions that is otherwise sealed. An absence of gross undesired evaporative emissions may be indicated if a threshold vacuum is met. In some examples, the fuel system and/or evaporative emissions system may be sealed subsequent to the threshold vacuum being reached, and an absence of non-gross undesired evaporative emissions may be indicated if a pressure bleed-up is less than a bleed-up threshold, or if a rate of pressure bleed-up is less than a bleed-up rate threshold. Failure to meet these criteria may indicate the presence of non-gross undesired evaporative emissions in the fuel system and/or evaporative emissions system. In some examples, an engine intake manifold vacuum may be used as the vacuum source applied to the emissions control system.

However, if the vehicle is in motion when such a test is conducted, any fuel slosh events in the fuel tank of the vehicle may result in the generation of fuel vapor which may adversely impact the pressure bleed-up portion of the test. Alternatively, to avoid fuel slosh events, such a test may be conducted at an engine idle condition. However, for an engine system disposed in a hybrid electric vehicle (HEV), such tests may be avoided due to engine idle in a HEV being an inefficient operating condition. Furthermore, the advent of start/stop (S/S) technology where the engine is shut down in response to vehicle speed and/or engine torque requests being below predetermined thresholds reduces engine idling conditions, thus limiting opportunity to conduct tests for undesired evaporative emissions that rely on engine intake manifold vacuum while the vehicle is stopped. Still further issues with conducting such tests while the vehicle is stopped include irregular engine idle durations. For example, in a case where an evaporative emissions test is initiated when the vehicle stops at a traffic light, if the traffic light changes prior to completion of the test, then the test may undesirably have to be aborted. Such issues may impact completion rates for tests for integrity of vehicle fuel systems and/or evaporative emissions systems.

Toward this end, U.S. Pat. No. 9,890,744 teaches systems and methods for conducting a test for undesired evaporative emissions that include evaluating a projected route responsive to receiving a cruise control signal, and initiating the test responsive to selected entry conditions being met. In this way, tests may be initiated under situations where it may be likely that the test may be completed without being aborted. However, such an approach may be prone to a variety of issues that may adversely impact such a test. For example, while the vehicle is in motion with cruise control set, changes in traffic conditions such as congestion, unexpected lane changes of other nearby vehicles, etc., may result in cruise control being disabled. In response to cruise control being disabled, the test for undesired evaporative emissions may be undesirably aborted.

The inventors herein have recognized the above-mentioned issues, and have developed systems and methods to at least partially address them. In one example, a method comprises adjusting evacuation of a fuel system and an evaporative emissions system of a vehicle in order to conduct a test for a presence or an absence of undesired evaporative emissions stemming from the fuel system and/or the evaporative emissions system, in response to a status of a traffic light that the vehicle is approaching. In this way, evacuation of the fuel system and the evaporative emissions system to conduct the test may be performed in such a way as to enable the test to provide results without being aborted due to the traffic light status.

In one example, adjusting evacuation of the fuel system and the evaporative emissions system may include evacuating the fuel system and the evaporative emissions system via a negative pressure with respect to atmospheric pressure that is communicated to the fuel system and the evaporative emissions system from an intake manifold of an engine. Yet, in another example, adjusting evacuation of the fuel system and the evaporative emissions system includes evacuating the fuel system and the evaporative emissions system via a pump positioned in the evaporative emissions system.

In another example, adjusting evacuation in order to conduct the test for the presence or absence of undesired evaporative emissions may include retrieving the status of the traffic light via wireless communication between a controller of the vehicle and a roadside unit corresponding to the traffic light.

In another example, adjusting evacuation of the fuel system and the evaporative emissions system may further include controlling evacuation of the fuel system and the evaporative emissions system in order to reach a threshold negative pressure in the fuel system and the evaporative emissions system at a time that coincides with the vehicle coming to a stop at the traffic light. As an example, in response to the threshold negative pressure being reached in the fuel system and the evaporative emissions system, the fuel system and the evaporative emissions system may be sealed. A pressure bleed-up may be monitored in the sealed fuel system and evaporative emissions system to indicate the presence or the absence of undesired evaporative emissions stemming from the fuel system and/or the evaporative emissions system while the vehicle is stopped at the traffic light.

As another example, the method may include maintaining current vehicle operating conditions without adjusting evacuation of the fuel system and the evaporative emissions system in response to an indication that the vehicle is predicted to pass through the traffic light without stopping.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for conducting an evaporative emissions test diagnostic to determine a presence or an absence of a source of undesired evaporative emissions stemming from a vehicle fuel system and/or an evaporative emissions system. Such systems and methods may be particularly applicable to hybrid electric vehicles, such as the hybrid vehicle system depicted at FIG. 1. The systems and methods described herein relate to the use of wireless communication between a control system of the vehicle and one or more smart traffic lights, such that the test diagnostic is initiated in response to an indication that the test will provide results, in other words not be aborted, based on traffic light status. More specifically, it may be desirable to conduct a pressure bleed-up portion of the test diagnostic while the vehicle is stationary (e.g. stopped at a traffic light), to avoid issues related to fuel slosh that may otherwise adversely impact the pressure bleed-up analysis. Accordingly, the systems and methods described herein relate to the use of wireless communication between the control system of the vehicle and a traffic light that the vehicle is decelerating to stop at, where the wireless communication provides information pertaining to a duration of time that the traffic light is predicted to remain red. In this way, the control system may infer whether at least the pressure bleed-up portion of the diagnostic may be conducted prior to the traffic light changing from red to green. Such an inference may improve completion rates for the test diagnostic.

Figure 2:
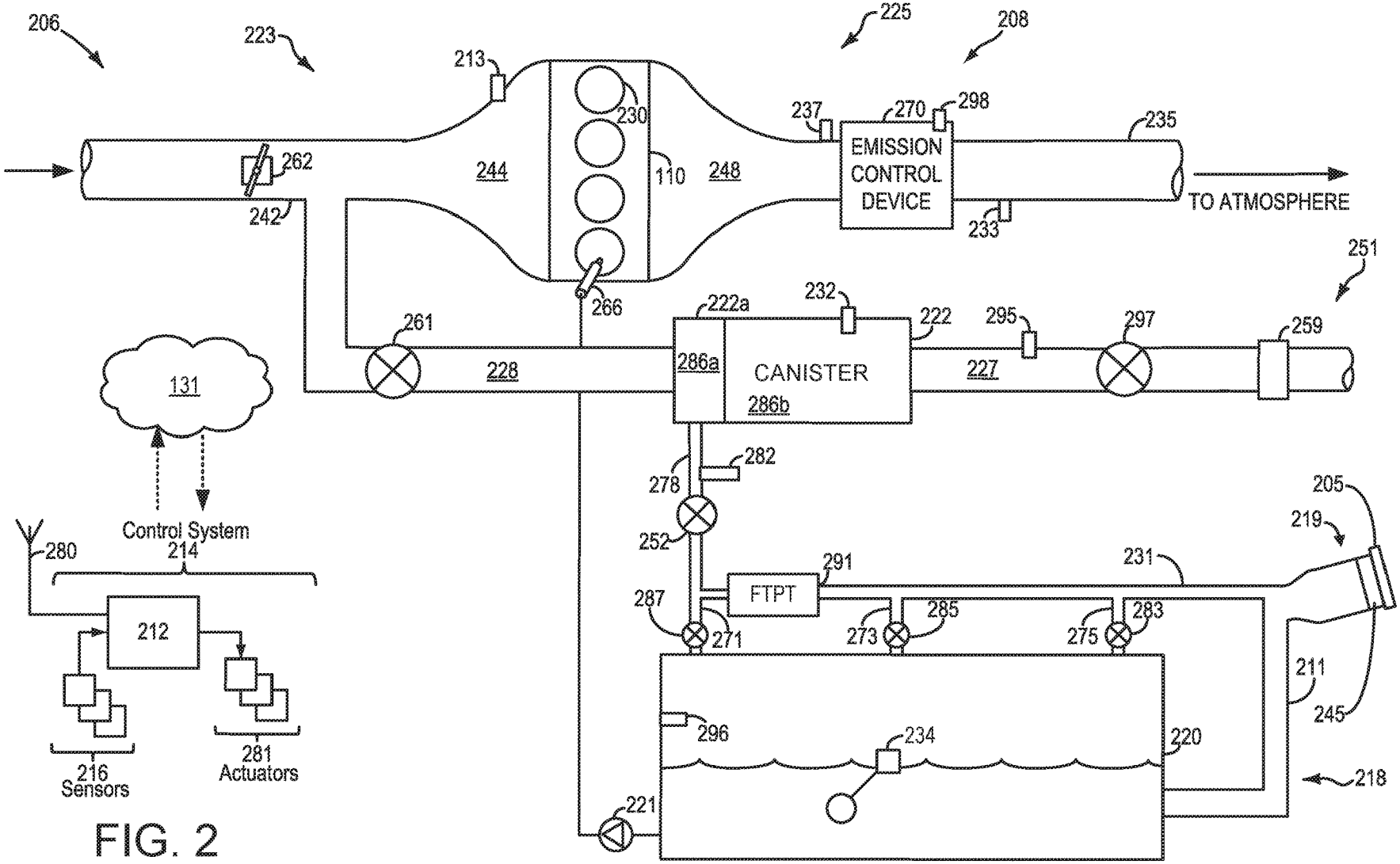
FIG. 2 schematically shows an example vehicle system with a fuel system and an evaporative emissions system.
Figure 3:
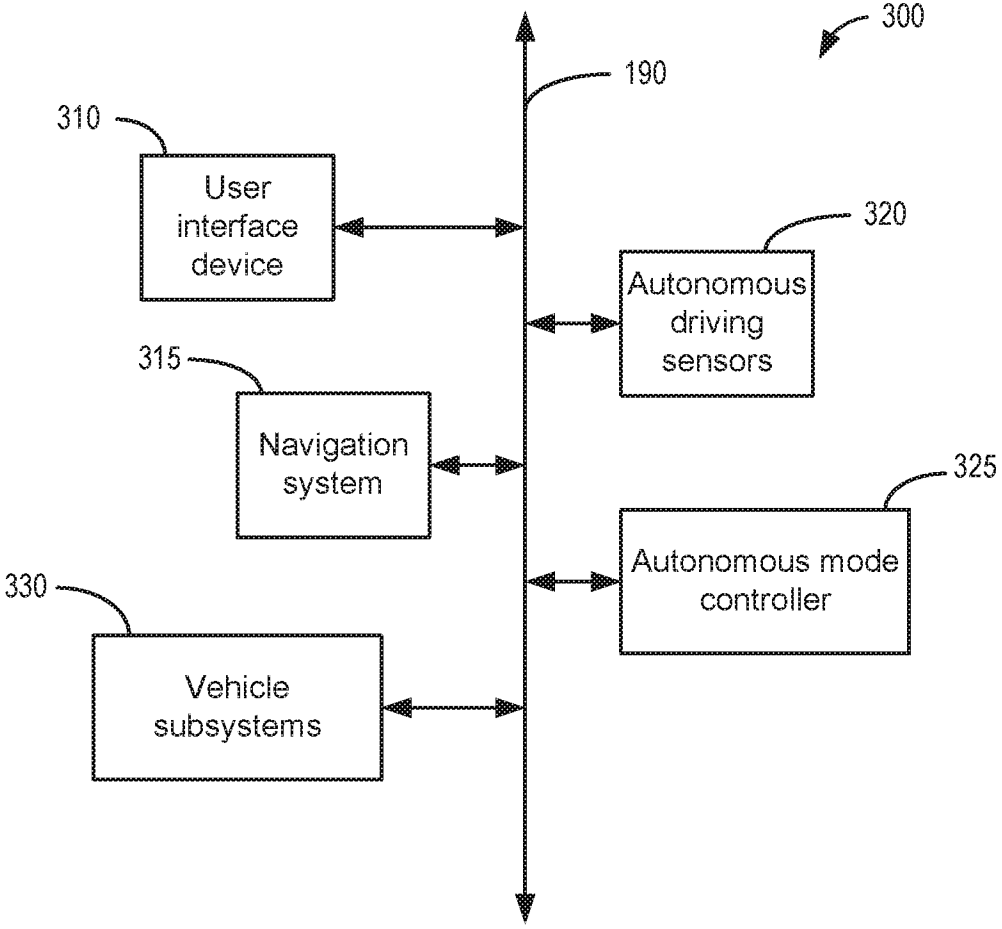
FIG. 3 schematically illustrates a block diagram of an example system for an autonomous vehicle.
Figure 4:
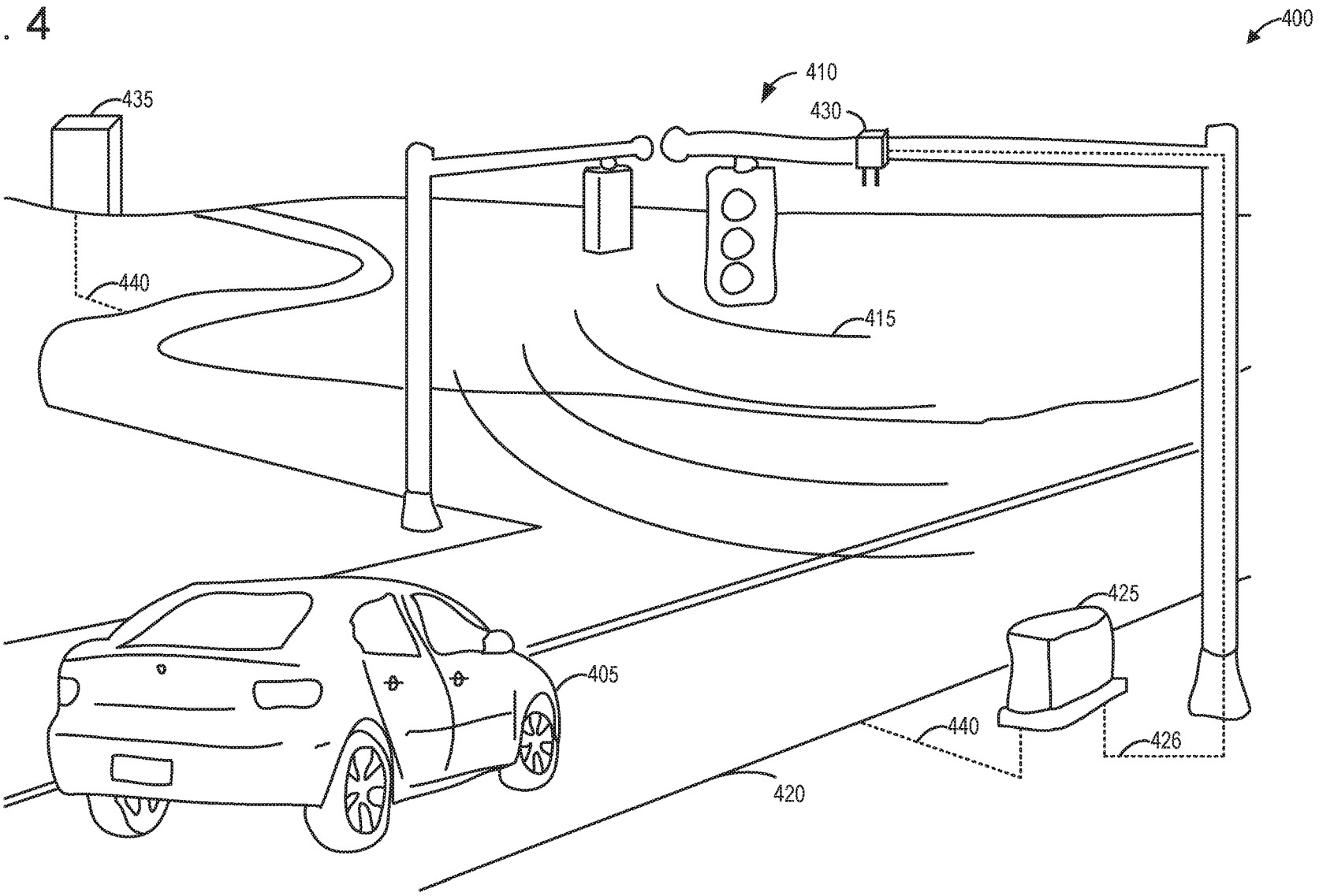
FIG. 4 schematically depicts an example of a smart traffic light system.
Figure 5:
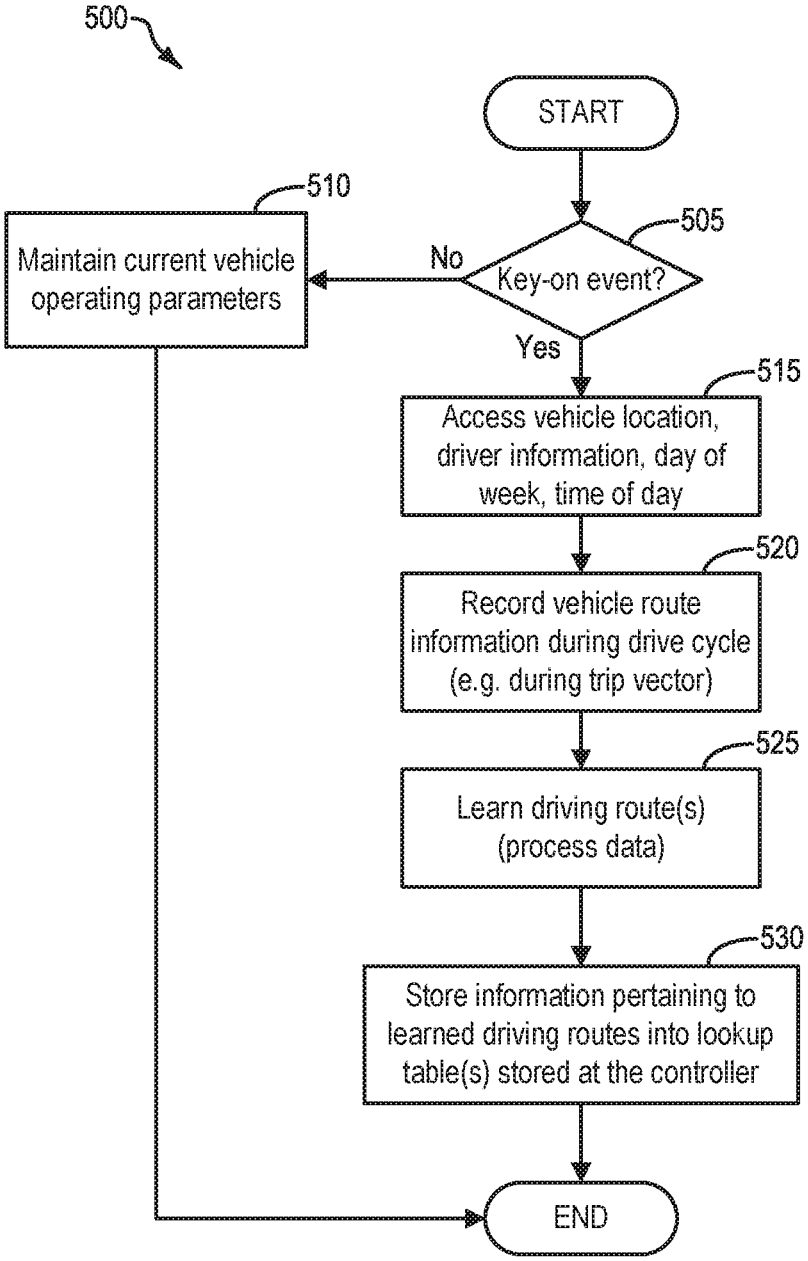
FIG. 5 depicts a high level flowchart for an example method for learning of common driving routes.
Figure 6:
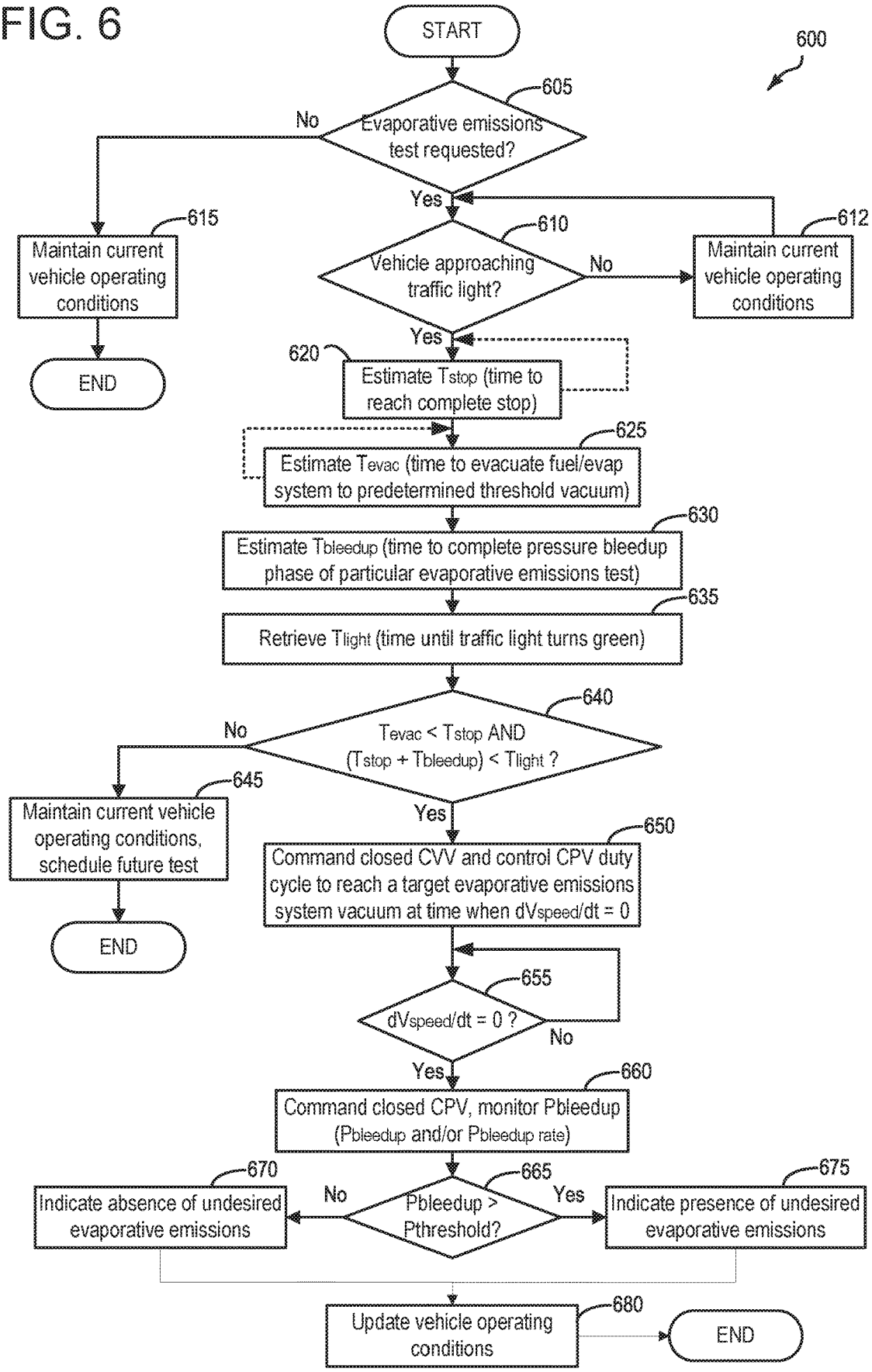
FIG. 6 depicts a high level flowchart for an example method for conducting an evaporative emissions test diagnostic based on a traffic light status.
Figure 7:
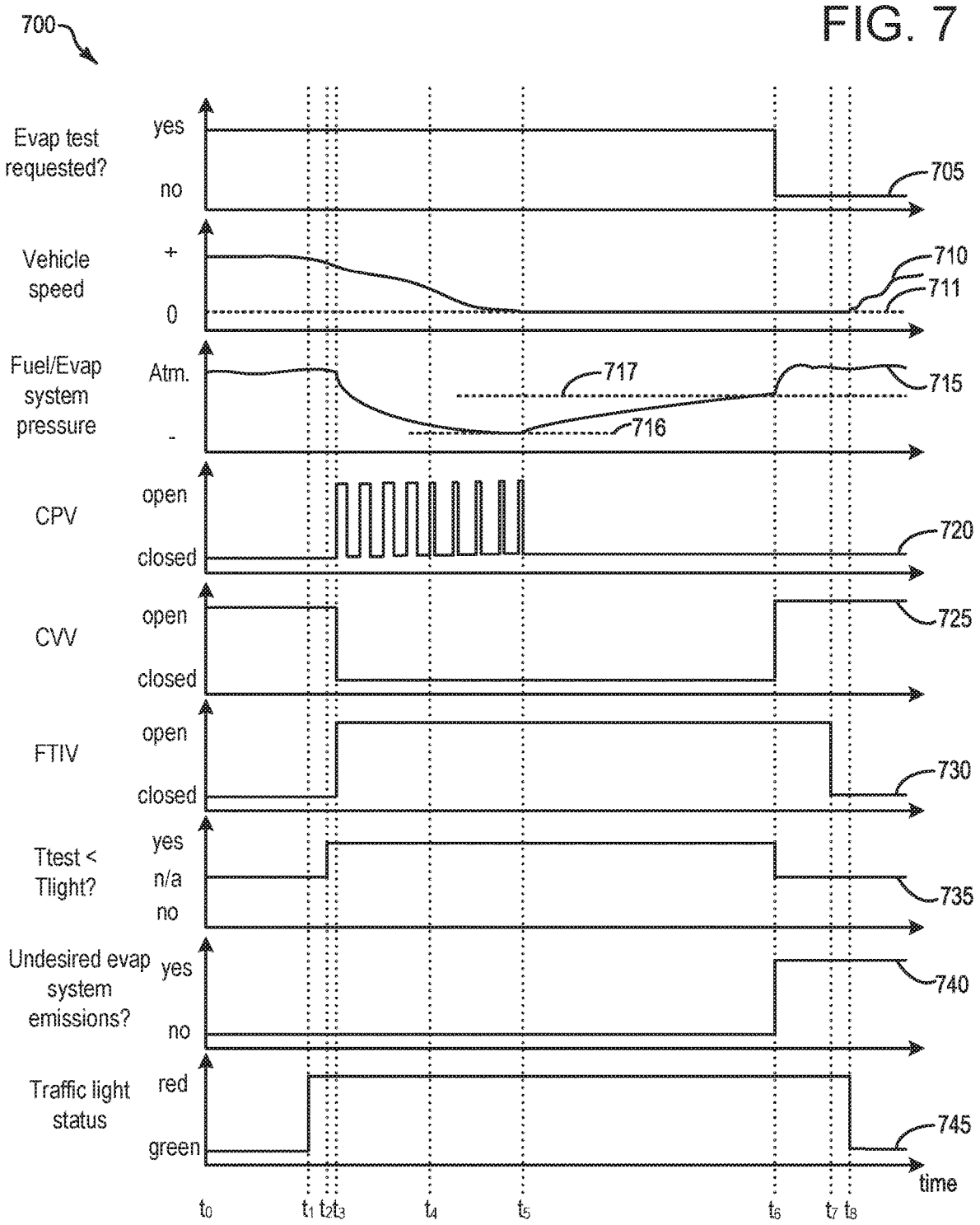
FIG. 7 depicts an example timeline for conducting the methodology of FIG. 6.

FIG. 2 depicts a vehicle system that includes the fuel system and the evaporative emissions system, along with an engine system. The systems and methods discussed herein may be applicable to autonomous vehicles, such as the autonomous vehicle system depicted at FIG. 3. An example illustration of a smart traffic light is depicted at FIG. 4. In some examples, the vehicle may employ route-learning methodology, which may be utilized to infer whether there may be one or more traffic lights potentially suitable for conducting the evaporative emissions test diagnostic along the route being traveled by the vehicle. Accordingly, FIG. 5 depicts an example method for route-learning. FIG. 6 depicts an example methodology for conducting the evaporative emissions test diagnostic that relies on knowledge of traffic light status, and FIG. 7 depicts an example timeline for conducting such a diagnostic, according to the method of FIG. 6.

Figure 1:
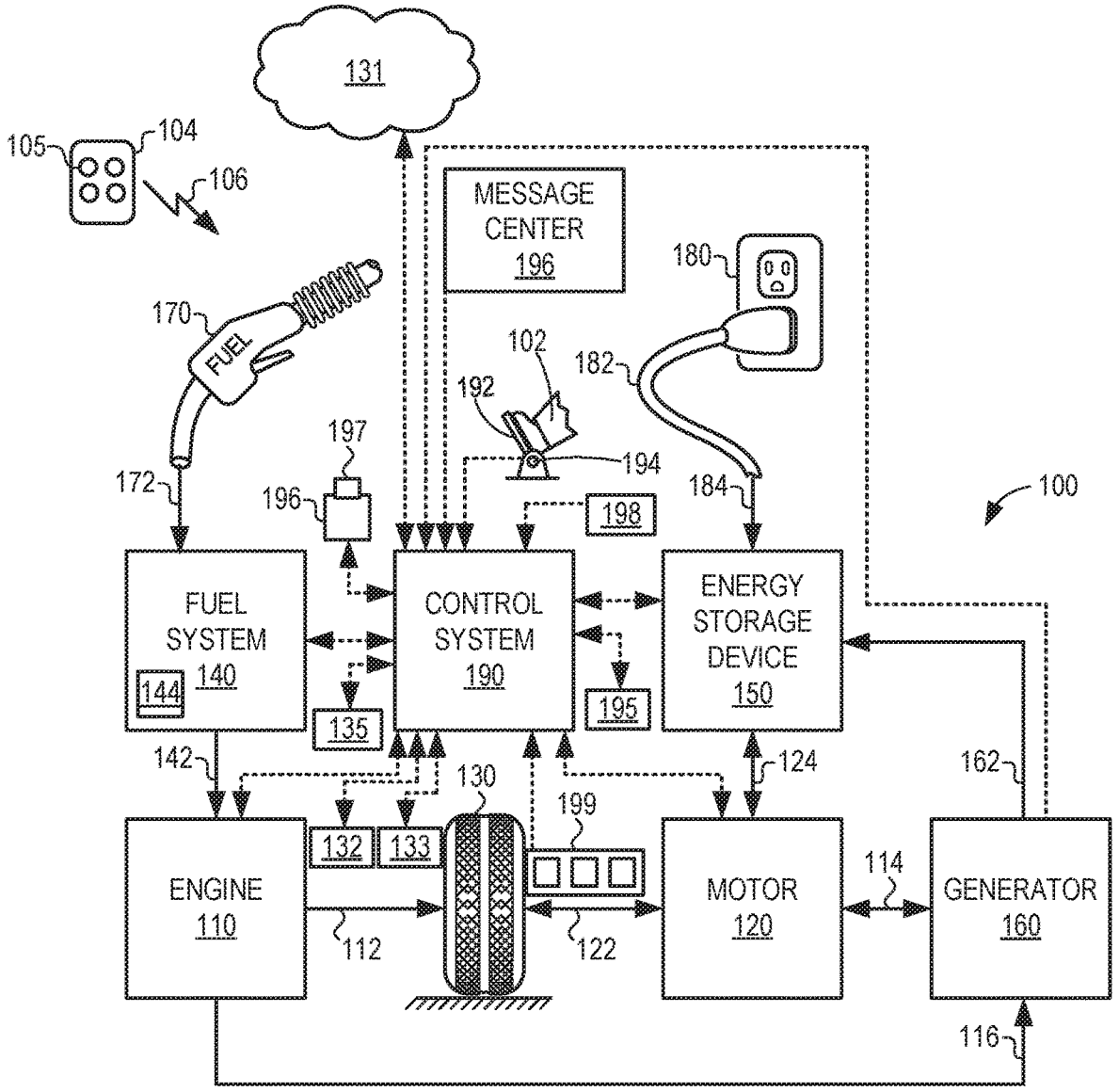
FIG. 1 shows a high-level block diagram illustrating an example vehicle system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some examples. However, in other examples, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some examples, motor 120 may propel the vehicle via a first set of drive wheels and engine 110 may propel the vehicle via a second set of drive wheels.

In other examples, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some examples, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal. Furthermore, in some examples control system 190 may be in communication with a remote engine start receiver 195 (or transceiver) that receives wireless signals 106 from a key fob 104 having a remote start button 105. In other examples (not shown), a remote engine start may be initiated via a cellular telephone, or smartphone based system where a user's cellular telephone sends data to a server and the server communicates with the vehicle to start the engine.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (PHEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other examples, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some examples, fuel tank 144 may be configured to store the fuel received from fuel dispensing device 170 until it is supplied to engine 110 for combustion. In some examples, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed.

In some examples, vehicle propulsion system 100 may include one or more onboard cameras 135. Onboard cameras 135 may communicate photos and/or video images to control system 190, for example. Onboard cameras may in some examples be utilized to record images within a predetermined radius of the vehicle, for example.

Control system 190 may be communicatively coupled to other vehicles or infrastructures using appropriate communications technology, as is known in the art. For example, control system 190 may be coupled to other vehicles or infrastructures via a wireless network 131, which may comprise Wi-Fi, Bluetooth, a type of cellular service, a wireless data transfer protocol, and so on. Control system 190 may broadcast (and receive) information regarding vehicle data, vehicle diagnostics, traffic conditions, vehicle location information, vehicle operating procedures, etc., via vehicle-to-vehicle (V2V), vehicle-to-infrastructure-to-vehicle (V2I2V), and/or vehicle-to-infrastructure (V2I or V2X) technology. The communication and the information exchanged between vehicles can be either direct between vehicles, or can be multi-hop. In some examples, longer range communications (e.g. WiMax) may be used in place of, or in conjunction with, V2V, or V2I2V, to extend the coverage area by a few miles. In still other examples, vehicle control system 190 may be communicatively coupled to other vehicles or infrastructures via a wireless network 131 and the internet (e.g. cloud), as is commonly known in the art.

Vehicle system 100 may also include an on-board navigation system 132 (for example, a Global Positioning System) that an operator of the vehicle may interact with. The navigation system 132 may include one or more location sensors for assisting in estimating vehicle speed, vehicle altitude, vehicle position/location, etc. This information may be used to infer engine operating parameters, such as local barometric pressure. As discussed above, control system 190 may further be configured to receive information via the internet or other communication networks. Information received from the GPS may be cross-referenced to information available via the internet to determine local weather conditions, local vehicle regulations, etc. In some examples, vehicle system 100 may include lasers, radar, sonar, acoustic sensors 133, which may enable vehicle location, traffic information, etc., to be collected via the vehicle.

FIG. 2 shows a schematic depiction of a vehicle system 206. It may be understood that vehicle system 206 may comprise the same vehicle system as vehicle system 100 depicted at FIG. 1. The vehicle system 206 includes an engine system 208 coupled to an emissions control system (evaporative emissions system) 251 and a fuel system 218. It may be understood that fuel system 218 may comprise the same fuel system as fuel system 140 depicted at FIG. 1. Emission control system 251 includes a fuel vapor container or canister 222 which may be used to capture and store fuel vapors. In some examples, vehicle system 206 may be a hybrid electric vehicle system. However, it may be understood that the description herein may refer to a non-hybrid vehicle, for example a vehicle equipped with an engine and not an motor that can operate to at least partially propel the vehicle, without departing from the scope of the present disclosure.

The engine system 208 may include an engine 110 having a plurality of cylinders 230. The engine 110 includes an engine air intake 223 and an engine exhaust 225. The engine air intake 223 includes a throttle 262 in fluidic communication with engine intake manifold 244 via an intake passage 242. Further, engine air intake 223 may include an air box and filter (not shown) positioned upstream of throttle 262. The engine exhaust system 225 includes an exhaust manifold 248 leading to an exhaust passage 235 that routes exhaust gas to the atmosphere. The engine exhaust system 225 may include one or more exhaust catalyst 270, which may be mounted in a close-coupled position in the exhaust. In some examples, an electric heater 298 may be coupled to the exhaust catalyst, and utilized to heat the exhaust catalyst to or beyond a predetermined temperature (e.g. light-off temperature). One or more emission control devices may include a three-way catalyst, lean NOx trap, diesel particulate filter, oxidation catalyst, etc. It will be appreciated that other components may be included in the engine such as a variety of valves and sensors. For example, a barometric pressure sensor 213 may be included in the engine intake. In one example, barometric pressure sensor 213 may be a manifold air pressure (MAP) sensor and may be coupled to the engine intake downstream of throttle 262. Barometric pressure sensor 213 may rely on part throttle or full or wide open throttle conditions, e.g., when an opening amount of throttle 262 is greater than a threshold, in order accurately determine BP.

Fuel system 218 may include a fuel tank 220 coupled to a fuel pump system 221. It may be understood that fuel tank 220 may comprise the same fuel tank as fuel tank 144 depicted above at FIG. 1. In an example, fuel tank 220 comprises a steel fuel tank. In some examples, the fuel system may include a fuel tank temperature sensor 296 for measuring or inferring a fuel temperature. The fuel pump system 221 may include one or more pumps for pressurizing fuel delivered to the injectors of engine 110, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system (referred to herein as evaporative emissions system) 251 which includes a fuel vapor canister 222 via vapor recovery line 231, before being purged to the engine air intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves may be positioned in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some examples, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some examples, refueling lock 245 may be a filler pipe valve located at a mouth of fuel filler pipe 211. In such examples, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some examples, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In examples where refueling lock 245 is locked using an electrical mechanism, refueling lock 245 may be unlocked by commands from controller 212, for example, when a fuel tank pressure decreases below a pressure threshold. In examples where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222, as discussed. The fuel vapor canisters may be filled with an appropriate adsorbent 286*b*, such that the canisters are configured to temporarily trap fuel vapors (including vaporized hydrocarbons) during fuel tank refilling operations and during diagnostic routines, as will be discussed in detail below. In one example, the adsorbent 286*b* used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent 286*a* in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and canister load may be estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve (CVV) 297 coupled within vent line 227. When included, the canister vent valve 297 may be a normally open valve, so that fuel tank isolation valve 252 (FTIV) may control venting of fuel tank 220 with the atmosphere. FTIV 252 may be positioned between the fuel tank and the fuel vapor canister 222 within conduit 278. FTIV 252 may be a normally closed valve, that when opened, allows for the venting of fuel vapors from fuel tank 220 to fuel vapor canister 222. Fuel vapors may then be vented to atmosphere, or purged to engine intake system 223 via canister purge valve 261.

In some examples, vent line 227 may include a pressure sensor 295. Such a pressure sensor may be configured to monitor pressure in evaporative emissions system 251 under conditions where FTIV 252 is closed.

Fuel system 218 may be operated by controller 212 in a plurality of modes by selective adjustment of the various valves and solenoids. It may be understood that control system 214 may comprise the same control system as control system 190 depicted above at FIG. 1. For example, the fuel system may be operated in a fuel vapor storage mode (e.g., during a fuel tank refueling operation and with the engine not combusting air and fuel), wherein the controller 212 may open isolation valve 252 (when included) while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252 (when included), while maintaining canister purge valve 261 closed, to depressurize the fuel tank before allowing enabling fuel to be added therein. As such, isolation valve 252 (when included) may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine combusting air and fuel), wherein the controller 212 may open canister purge valve 261 while closing isolation valve 252 (when included). Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold. In some examples, purging may include additionally commanding open the FTIV, such that fuel vapors from the fuel tank may additionally be drawn into the engine for combustion. It may be understood that purging the canister further includes commanding or maintaining open CVV 297.

Thus, CVV 297 may function to adjust a flow of air and vapors between canister 222 and the atmosphere, and may be controlled during or prior to diagnostic routines. For example, the CVV may be opened during fuel vapor storing operations (for example, during fuel tank refueling) so that air, stripped of fuel vapor after having passed through the canister, can be pushed out to the atmosphere. Likewise, as mentioned above, during purging operations (for example, during canister regeneration and while the engine is running) the CVV may be opened to allow a flow of fresh air to strip the fuel vapors stored in the canister.

In some examples, CVV 297 may be a solenoid valve wherein opening or closing of the valve is performed via actuation of a canister vent solenoid. In particular, the canister vent valve may be a normally open valve that is closed upon actuation of the canister vent solenoid. In some examples, CVV 297 may be configured as a latchable solenoid valve. In other words, when the valve is placed in a closed configuration, it latches closed without requiring additional current or voltage. For example, the valve may be closed with a 100 ms pulse, and then opened at a later time point with another 100 ms pulse. In this way, the amount of battery power required to maintain the CVV closed may be reduced.

Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device 270, temperature sensor 233, pressure sensor 291, pressure sensor 295, and canister temperature sensor 232. Other sensors such as pressure, temperature, air/fuel ratio, and composition sensors may be coupled to various locations in the vehicle system 206. As another example, the actuators may include throttle 262, fuel tank isolation valve 252, canister purge valve 261, and canister vent valve 297. Controller 212 may receive input data from the various sensors, process the input data, and trigger the actuators in response to the processed input data based on instruction or code programmed therein corresponding to one or more routines. Example control routines are described herein with regard to FIGS. 5-6.

In some examples, the controller may be placed in a reduced power mode or sleep mode, wherein the controller maintains essential functions only, and operates with a lower battery consumption than in a corresponding awake mode. For example, the controller may be placed in a sleep mode following a vehicle-off event in order to perform a diagnostic routine at a duration after the vehicle-off event. The controller may have a wake input that allows the controller to be returned to an awake mode based on an input received from one or more sensors, or via expiration of a timer set such that when the timer expires the controller is returned to the awake mode. In some examples, the opening of a vehicle door may trigger a return to an awake mode. In other examples, the controller may need to be awake in order to conduct such methods. In such an example, the controller may stay awake for a duration referred to as a time period where the controller is maintained awake to perform extended shutdown functions, such that the controller may be awake to conduct evaporative emissions test diagnostic routines.

Undesired evaporative emissions detection routines may be intermittently performed by controller 212 on fuel system 218 and/or evaporative emissions system 251 to confirm that undesired evaporative emissions are not present in the fuel system and/or evaporative emissions system. As discussed above, one example test diagnostic for undesired evaporative emissions includes application of engine manifold vacuum on the fuel system and/or evaporative emissions system that is otherwise sealed from atmosphere, and in response to a threshold vacuum being reached, sealing the evaporative emissions system from the engine and monitoring pressure bleed-up in the evaporative emissions system to ascertain a presence or absence of undesired evaporative emissions. However, issues related to fuel slosh may complicate interpretation of such tests when the tests are conducted while the vehicle is in motion. Such issues may be avoided by conducting a test for presence or absence of undesired evaporative emissions while the vehicle is stationary such as when the vehicle stops at a traffic light, but such methodology may often result in the test being aborted due to the traffic light changing prior to the test being completed. Still further, when relying on engine manifold vacuum to evacuate the fuel system and/or evaporative emissions system for conducting such tests, if the vehicle comprises a S/S vehicle where the engine is pulled down when the vehicle is stopped, then engine manifold vacuum may not be able to be used for evacuating the fuel system and/or evaporative emissions system. Systems and methods to address such issues are herein discussed, particularly with regard to the methodology of FIG. 6.

Controller 212 may include wireless communication device 280, to enable wireless communication between the vehicle and other vehicles or infrastructures, via wireless network 131.

Such systems and methods may be applicable to autonomous vehicles. Accordingly, turning now to FIG. 3, a block diagram of an example autonomous driving system 300 that may operate, for example, the vehicle system 100, described above at FIG. 1. Herein, the vehicle system 100 will be referred to simply as a "vehicle". The autonomous driving system 300, as shown, includes a user interface device 310, a navigation system 315 (e.g. same as 132), at least one autonomous driving sensor 320, an autonomous mode controller 325, and vehicle subsystems 330.

The user interface device 310 may be configured to present information to vehicle occupants, under conditions wherein a vehicle occupant may be present. However, it may be understood that the vehicle may be operated autonomously in the absence of vehicle occupants, under certain conditions. The presented information may include audible information or visual information. Moreover, the user interface device 310 may be configured to receive user inputs. Thus, the user interface device 310 may be located in the passenger compartment (not shown) of the vehicle. In some possible approaches, the user interface device 310 may include a touch-sensitive display screen.

The navigation system 315 may be configured to determine a current location of the vehicle using, for example, a Global Positioning System (GPS) receiver configured to triangulate the position of the vehicle relative to satellites or terrestrial based transmitter towers. The navigation system 315 may be further configured to develop routes from the current location to a selected destination, as well as display a map and present driving directions to the selected destination via, for example, the user interface device 310.

The autonomous driving sensors 320 may include any number of devices configured to generate signals that help navigate the vehicle. Examples of autonomous driving sensors 320 may include a radar sensor, a lidar sensor, a vision sensor (e.g. a camera), vehicle to vehicle infrastructure networks, or the like. The autonomous driving sensors 320 may enable the vehicle to "see" the roadway and vehicle surroundings, and/or negotiate various obstacles while the vehicle 100 is operating in autonomous mode. The autonomous driving sensors 320 may be configured to output sensor signals to, for example, the autonomous mode controller 325.

The autonomous mode controller 325 may be configured to control one or more subsystems 330 while the vehicle is operating in the autonomous mode. Examples of subsystems 330 that may be controlled by the autonomous mode controller 325 may include a brake subsystem, a suspension subsystem, a steering subsystem, and a powertrain subsystem. The autonomous mode controller 325 may control any one or more of these subsystems 330 by outputting signals to control units associated with subsystems 330. In one example, the brake subsystem may comprise an anti-lock braking subsystem, configured to apply a braking force to one or more of wheels (e.g. 130). Discussed herein, applying the braking force to one or more of the vehicle wheels may be referred to as activating the brakes. To autonomously control the vehicle, the autonomous mode controller 325 may output appropriate commands to the subsystems 330. The commands may cause the subsystems to operate in accordance with the driving characteristics associated with the selected driving mode. For example, driving characteristics may include how aggressively the vehicle accelerates and decelerates, how much space the vehicle leaves behind a front vehicle, how frequently the autonomous vehicle changes lanes, etc.

As discussed above, the vehicle control system (e.g. 190) may broadcast and receive information regarding vehicle data, vehicle diagnostics, traffic conditions, vehicle location information, vehicle operating procedures, etc., via vehicle-to-vehicle (V2V), vehicle-to-infrastructure-to-vehicle (V2I2V), and/or vehicle-to-infrastructure (V2I or V2X) technology. Turning now to FIG. 4, an example illustration 400 is shown depicting one example of how a vehicle 405 (which may be the vehicle system discussed above with regard to FIGS. 1-3) may be in wireless communication with infrastructure that includes traffic lights. Said another way, example illustration 400 depicts a smart traffic light 410 in wireless communication 415 with vehicle 405. Smart traffic light 410 may communicate to vehicle 405 status of smart traffic light 410. For example, smart traffic light 410 may communicate to vehicle 405 how much time is remaining until the light changes from red to green. In another example, smart traffic light 410 may communicate to vehicle 405 how much time is remaining until the light changes from green to red. It is herein recognized that such capability may enable initiation of a test for undesired evaporative emissions at a vehicle stop event under circumstances where the test is predicted or inferred to return results prior to conditions changing where such a test may have to be aborted, as will be discussed in further detail below.

Example illustration 400 thus includes vehicle 405, traveling along road 420. Depicted is traffic signal controller 425. Traffic signal controller may transfer information via wired communication 426 on traffic signal phase (e.g. whether the signal is green, yellow or red, duration of time until light changes, etc.), to roadside unit 430. Roadside unit 430 may then broadcast (e.g. wireless communication 415) or transmit such information to vehicle 405, where it may be processed via the controller (e.g. 212). As depicted, the transfer of information between traffic signal controller 425 and roadside unit 430 is via wired communication 426, although in other embodiments such communication may be wireless, without departing from the scope of this disclosure. A traffic management center 435 may collect and process data related to traffic information and/or vehicle information. For example, cables 440 (e.g. fiber optics cables) may communicatively connect traffic signal controller 425 with traffic management center 435, and traffic management center 435 may further be in wireless communication with vehicle 405 (and other vehicles which are not shown in illustration 400). While cables 440 are depicted as providing the communication of information between traffic signal controller 425 and traffic management center 435, it may be understood that in other examples such communication may comprise wireless communication, without departing from the scope of this disclosure. Furthermore, traffic management center 435 may comprise one of a local or state back office, private operator, etc.

While not explicitly illustrated, traffic information may in some examples be additionally or alternatively communicated to vehicle 405 via communication between vehicle 405 and other vehicles (V2V communication). Specifically, another vehicle or vehicles that have waited at the same traffic light (e.g. 410) may communicate duration of time that the traffic light stays red, for example, to vehicle 405. Similarly, vehicle 405 may determine such information, and may communicatively broadcast such information to other vehicles.

Discussed herein, the systems and methods may enable a system for a vehicle, comprising a fuel system selectively fluidically coupled to an evaporative emissions system that is selectively fluidically coupled to an engine and to atmosphere. Such a system may further include a controller with computer readable instructions stored on non-transitory memory that when executed, cause the controller to, in response to the vehicle decelerating in order to stop at a traffic light, send a wireless request to a roadside unit corresponding to the traffic light, the request including information pertaining to a status of the traffic light. The controller may store further instructions to wirelessly receive the information pertaining to the status of the traffic light from the roadside unit. The controller may store further instructions to commence initiation of a test to determine a presence or an absence of a source of undesired evaporative emissions stemming the fuel system and/or the evaporative emissions system in response to a prediction that the fuel system and the evaporative emissions system will be evacuated to a threshold negative pressure while the vehicle is decelerating to stop at the traffic light, and in further response to an indication that a pressure bleed-up portion of the test that is conducted while the vehicle is stopped at the traffic light will provide results prior to the traffic light changing status from red to green.

In one example of the system, the system may further include a canister purge valve selectively fluidically couples the evaporative emissions system to the engine. In such an example, the controller may store further instructions to control a duty cycle of the canister purge valve in order to evacuate the fuel system and the evaporative emissions system to the threshold negative pressure at a time coinciding with the vehicle stopping at the light, where controlling the duty cycle of the canister purge valve regulates an amount of vacuum that is communicated from the engine to the fuel system and the evaporative emissions system. Such a system may further comprise a fuel tank isolation valve that selectively fluidically couples the fuel system to the evaporative emissions system, and a canister vent valve that selectively fluidically couples the evaporative emissions system to atmosphere. In such an example, the controller may store further instructions to command open the fuel tank isolation valve and command closed the canister vent valve for evacuating the fuel system and the evaporative emissions system to the threshold negative pressure. The controller may store further instructions to, in response to the vehicle stopping at the traffic light, command the fuel tank isolation valve maintained open, command the canister vent valve maintained closed, and command the canister purge valve closed to seal the fuel system and the evaporative emissions system in order to conduct the pressure bleed-up portion of the test.

Still further, in such a system, the controller may store further instructions to determine a duration of time for conducting the pressure bleed-up portion of the test as a function of a diameter of the source of undesired evaporative emissions that the test diagnostic is testing for, in order to indicate that the pressure bleed-up portion of the test conducted while the vehicle is stopped at the traffic light may provide results prior to the traffic light changing status from red to green.

Continuing on, as mentioned above and which will be further elaborated below, such information related to traffic light duration may be advantageously utilized via a vehicle (e.g. 405) to conduct a test for presence or absence of undesired evaporative emissions under circumstances where it is predicted or inferred that the test is likely to return results prior to the vehicle being requested to be propelled from a stopped condition. Accordingly, as mentioned in some examples it may be desirable for the controller of the vehicle to infer whether there may be a traffic light or lights along a route that the vehicle is traveling, to conduct such a test. Such an inference may be made via V2X communication, and may in some examples include information related to either route information that is input (e.g. via a vehicle operator, or a customer in a case of a vehicle participating in a car-sharing model where the customer may schedule pickup of the vehicle for use) into the onboard navigation system (e.g. 132) or is inferred via route-learning methodology. For example, if a vehicle operator or customer inputs a particular route into the onboard navigation system, the onboard navigation system may determine whether or not there are one or more traffic lights along said route for conducting a diagnostic test for presence or absence of undesired evaporative emissions. In another example, the controller of a vehicle may learn, over time, particular routes that the vehicle is commonly traveled along. Such learned information may include information related to number of predicted potential stops at traffic lights along a particular learned route, estimates of times that particular traffic lights remain red/green, etc. In utilizing such information, the vehicle controller may make determinations as to potential vehicle stop events where it may be desirable to conduct a test for presence or absence of undesired evaporative emissions, where it may be likely that such a test will return results prior to a request to once again propel the vehicle.

Accordingly, turning to FIG. 5, a high-level example method 500 for learning common driving routes driven in a vehicle, is shown. More specifically, method 500 may be utilized to learn common driving routes, and may further be utilized to learn/predict location and in some examples duration of potential stops and stop durations associated with particular driving routes. It may be understood that "stops" herein may refer to events where the vehicle is stopped but where the vehicle is not deactivated, or turned off. In other words, such stop events may correspond to the vehicle stopping at a traffic light, for example, where the vehicle is stopped for a duration of time dictated by the light, and then is resumed being propelled. Such a stop event is in contrast to stop events where the vehicle is deactivated (e.g. a key-off event) and where a vehicle operator or customer exits the vehicle. It may be understood that for vehicles equipped with S/S capability, such stops events at traffic lights may be accompanied by engine pull-down where the engine is deactivated to stop combusting air and fuel. Learned/inferred durations for particular learned/predicted stops corresponding to a particular driving route may be stored in lookup table(s) stored at the vehicle controller. Such information may in some examples be relied upon in order to schedule appropriate evaporative emissions test diagnostic procedures.

Method 500 will be described with reference to the systems described herein and shown in FIGS. 1-4, though it should be understood that similar methods may be applied to other systems without departing from the scope of this disclosure. Method 500 may be carried out by a controller, such as controller 212 in FIG. 2, and may be stored at the controller as executable instructions in non-transitory memory. Instructions for carrying out method 500 and the rest of the methods included herein may be executed by the controller based on instructions stored on a memory of the controller and in conjunction with signals received from sensors of the engine system, such as the sensors described above with reference to FIGS. 1-3. The controller may employ fuel system and evaporative emissions system actuators such as canister vent valve (CVV) (e.g. 297), canister purge valve (CPV) (e.g. 261), etc., along with engine system actuators (e.g. fuel injectors 266, throttle 262, etc.) according to the methods depicted below.

Method 500 begins at 505 and may include indicating whether a key-on event is indicated. A key-on event may comprise an ignition key being utilized to start a vehicle either in an engine-on mode, or an electric only mode of operation. In other examples, a key-on event may comprise an ignition button on the dash, for example, being depressed. Other examples may include a key-fob (or other remote device including smartphone, tablet, etc.) starting the vehicle in either an engine-on mode, or an electric-only mode of operation. If, at 805, a key-on event is not indicated, method 500 may proceed to 510, and may include maintaining current vehicle operating parameters. For example, at 510, method 500 may include maintaining a CPV, CVV, FTIV, engine, etc., in their current conformations and or current modes of operation. Method 500 may then end.

Returning to 505, responsive to a key-on event being indicated, method 500 may proceed to 515, and may include accessing vehicle location, driver information, day of the week (DOW), time of day (TOD), etc. A driver's identity may be input by the driver, or inferred based on driving habits, seat position, cabin climate control preferences, voice activated commands, etc. Vehicle location may be accessed via an onboard navigation system, for example via GPS, or other means such as via wireless communication with the internet.

Proceeding to 520, method 500 may include recording vehicle route information during the drive cycle commencing from the key-on event. In some examples, vehicle route information may be divided into one or more segments, with the one or more segments being bordered by a key-on event indicating a start location, and a key-off event indicating a final destination.

At 520, the vehicle controller may continuously collect data from various sensor systems and outside sources regarding the vehicle's operations/conditions, location, traffic information, local weather information, etc. The data may be collected by, for example, GPS (e.g. 132), inertial sensors (e.g. 199), lasers, radar, sonar, acoustic sensors, etc. (e.g. 133). Other feedback signals, such as input from sensors typical of vehicles may also be read from the vehicle. Example sensors may include tire pressure sensors, engine temperature sensors, brake heat sensors, brake pad status sensors, tire tread sensors, fuel sensors, oil level and quality sensors, and air quality sensors for detecting temperature, humidity, etc. Still further, at 520, the vehicle controller may also retrieve various types of non-real time data, for example information from a detailed map, which may be stored in at the controller or which may be retrieved wirelessly.

Accordingly, data regarding a particular vehicle driving route, or trip vector, may be obtained and stored at the vehicle controller during the course of the vehicle being driven along the particular route. Proceeding to 525, method 500 may include processing the data to establish predicted/learned driving routes. For example, numerous trip vectors and corresponding information may be obtained and stored at the vehicle controller, such that predicted/learned driving routes may be achieved with high accuracy. In some examples, a vehicle may travel route(s) that are not frequently traveled (e.g. not "common"). Thus, it may be understood that route information that is not correlated significantly with commonly driven routes may be periodically forgotten, or removed, from the vehicle controller, in order to prevent the accumulation of exorbitant amounts of data pertaining to vehicle travel routines.

In some examples data collected from the vehicle travel routines including GPS data may be applied to an algorithm that feeds into one or more machine learning algorithms to determine common vehicle travel routes. Such an example is meant to be illustrative, and is not meant to be limiting. For example, any commonly used methodology for vehicle route learning may be utilized via the vehicle controller in order to establish learned travel routes without departing from the scope of this disclosure.

Learning driving routes at 525 may include determining traffic light locations along the route where the vehicle may potentially be requested to stop. In some examples, such learned information may comprise durations that particular traffic lights remain red, durations that particular traffic lights remain green, etc. As discussed above and which will be discussed in further detail below, such information may be utilized to schedule evaporative emissions test diagnostics.

Proceeding to 530, method 500 may include storing information pertaining to learned driving routes into one or more lookup table(s) at the vehicle controller. Such information may include segments of particular vehicle routes in which a particular traffic light (and thus potential stop) is indicated, and may further include an indication of a learned/predicted time duration of each indicated stop. Such lookup tables may be utilized during particular vehicle driving routines in order to schedule evaporative emissions test diagnostic procedures such that robust results may be obtained without the test being aborted. More specifically, a test for presence or absence of undesired evaporative emissions may only be initiated for a particular traffic stop if it is inferred that the test is likely to return results prior to the vehicle being again requested to be propelled. Such methodology is discussed in detail with regard to FIG. 6.

Turning now to FIG. 6, a high level example method 600 for initiating and conducting a test for undesired evaporative emissions, is depicted. Specifically, method 600 depicts an example methodology whereby, in response to a request to conduct a test for presence or absence of a source of undesired evaporative emissions stemming from the fuel system and/or evaporative emissions system, it may be determined whether there are one or more potential traffic stops along the route the vehicle is traveling. If so, via the methodology of method 600, it may be determined whether one or more of the traffic stops may enable a test for undesired evaporative emissions to be conducted during a timeframe that the vehicle is stopped at a light. In a situation where it is predicted or inferred that the duration of time the vehicle will be stopped at a particular light is of a duration sufficient for the test to be completed (in other words, return or provide results), then the test may be initiated and conducted according to the methodology depicted at FIG. 6.

Method 600 will be described with reference to the systems described herein and shown in FIGS. 1-4, though it should be understood that similar methods may be applied to other systems without departing from the scope of this disclosure. Method 600 may be carried out by a controller, such as controller 212 in FIG. 2, and may be stored at the controller as executable instructions in non-transitory memory. Instructions for carrying out method 600 and the rest of the methods included herein may be executed by the controller based on instructions stored on a memory of the controller and in conjunction with signals received from sensors of the engine system, such as the sensors described above with reference to FIGS. 1-3. The controller may employ fuel system and evaporative emissions system actuators such as canister vent valve (CVV) (e.g. 297), canister purge valve (CPV) (e.g. 261), etc., along with engine system actuators (e.g. fuel injectors 266, throttle 262, etc.) according to the methods depicted below.

Method 600 begins at 605, and includes determining whether an evaporative emissions test is requested via the controller of the vehicle. For example, the vehicle controller may request an evaporative emissions test on the fuel system and/or evaporative emissions system in response to a predetermined amount of time passing since a prior test, in response to an indication that there may be a source of undesired evaporative emissions (e.g. unexpected air/fuel ratio, etc.) stemming from the fuel system and/or evaporative emissions system, etc. In some examples, a request for such a test for presence or absence of undesired evaporative emissions may comprise a scheduled test.

If, at 605, such a test is not requested, method 600 may proceed to 615. At 615, method 600 may include maintaining current vehicle operating conditions. In other words, current vehicle operating conditions may be maintained without commanding a sequence of actions for conducting the test diagnostic. For example, if the vehicle is being propelled via the engine, then such operation may be maintained and current operational status of valves such as the CPV (e.g. 261), CVV (e.g. 297), FTIV (e.g. 291), etc., may be maintained. Similarly, if the vehicle is being propelled via electric power, or some combination of the engine and electrical power, then such operation may be maintained. Method 600 may then end.

Returning to 605, if it is indicated that a test for undesired evaporative emissions is requested, method 600 may proceed to 610. At 610, method 600 may include determining whether the vehicle may be approaching a traffic light where it may be possible to conduct a test for undesired evaporative emissions while the vehicle is stopped at the light. Such a determination may be made via wireless communication between a smart traffic light (e.g. see 410) and the controller (e.g. 212) of the vehicle (e.g. V2I communications). Such a determination may in some examples be further made via querying one or more lookup tables stored at the controller relating to learned routes, or in some examples a route that is selected for example via use of the onboard navigation system. For example, if the vehicle is traveling along a route that has been learned (or selected/input) and is thus known to the controller, based on current location of the vehicle along the route (determined for example via the onboard navigation system), it may be determined as to whether the vehicle is approaching a traffic light. In still further examples, it may be inferred that a vehicle is approaching a traffic light where an evaporative emissions test diagnostic may be conducted if the vehicle is in a coast down phase, where engine torque is not being requested (either autonomously or via an operator of the vehicle), and where vehicle speed is slowing. Said another way, a traffic light suitable for conducting an evaporative emissions test diagnostic may be approaching provided that engine torque is not being requested, and where one or more of V2I communications with the traffic light and/or learned or selected route information indicate that the vehicle is approaching the traffic light.

As one example, if the vehicle has entered into a deceleration fuel shut off (DFSO) mode of operation where fuel injection to one or more engine cylinders is shut off due to an inference via the controller of a request to decelerate the vehicle, then it may be ascertained that the vehicle is approaching a traffic light suitable for conducting an evaporative emissions test diagnostic (provided V2I communications and/or learned or selected route information further indicate a traffic light along the route the vehicle is travelling). In other words, a DFSO event (or other deceleration event) in and of itself may not indicate that the vehicle is approaching a traffic light, however in conjunction with one or more of route learning methodology (or a selected route) and/or V2I communications with street lights and/or V2V communications with nearby vehicles, a DFSO event or other deceleration event may provide an indication that the vehicle is slowing in order to stop at a traffic light.

Thus, at 610 it may be indicated as to whether the vehicle is approaching a traffic light suitable for conducting an evaporative emissions test diagnostic. If the vehicle is not slowing, for example if the vehicle has not entered a DFSO mode or if engine torque is continuing to be requested, then the vehicle may be approaching a traffic light (indicated for example via V2I communications) but the light may be green. If the vehicle passes through the traffic light without having to stop, then the evaporative emissions test may not be able to be conducted. Accordingly, at 610, it may only be ascertained that the vehicle is approaching a traffic light suitable for conducting an evaporative emissions test diagnostic if 1) the vehicle is decelerating to a standstill and, 2) via one or more of V2I communications between the controller of the vehicle and the traffic light the vehicle is approaching, and/or learned or selected route information, it is indicated that a traffic light is along the route current being traveled via the vehicle that coincides with the vehicle deceleration.

If, at 610, the above identified conditions are not satisfied, then it may be ascertained that the vehicle is not approaching a traffic light suitable for conducting an evaporative emissions test diagnostic. Accordingly, method 600 may proceed to 612, where current vehicle operating conditions may be maintained. As an example, fuel injection to engine cylinders may be maintained as a function of driver demanded engine torque, and fuel system and/or evaporative emissions system components may be maintained in their current operational state. For example, the CPV (e.g. 261), FTIV (e.g. 291) and CVV (e.g. 297) may be maintained in their current configurations.

However, there may be other opportunities along the route the vehicle is currently traveling, to conduct an evaporative emissions test diagnostic at a traffic light, provided that the above-identified conditions are satisfied for doing so. In other words, there may be a plurality of traffic lights along the current route the vehicle is traveling, each of which may be options for conducting the evaporative emissions test diagnostic. Accordingly, if conditions at 610 do not indicate that the vehicle is approaching a traffic light suitable for conducting the evaporative emissions test diagnostic, the controller may continue to query whether such conditions are met as the vehicle continues along its route. An exception to this may be a case where one or more of learned route information, selected route information, and/or V2I communications indicate that there is not a traffic light along the current route. For example, certain driving routines may encounter stop signs, for example, but not actual traffic lights. In such an example, while not explicitly illustrated, it may be understood that method 600 may be aborted.

If, at 610, it is indicated that the vehicle is approaching a traffic light that is suitable for conducting an evaporative emissions test diagnostic, method 600 may proceed to 620. At 620, method 600 may include estimating a time it will take for the vehicle to reach a complete stop at the light. Such an estimation may be made based on a change in vehicle speed over time, and in conjunction with one or more of the onboard navigation system (GPS) and navigation sensors. For example, as discussed above, the vehicle may include one or more of lasers, radar, sonar and acoustic sensors, vision sensors (e.g. camera), etc. Such sensors may be utilized in order to provide relevant information to the vehicle controller such that the controller may estimate a duration it will take for the vehicle to come to a stop at the traffic light.

It may be understood that although the vehicle may be decelerating to a stop at a traffic light whereby an estimation of how long it will take for the vehicle to reach a standstill, traffic conditions may change. For example, another vehicle may change lanes suddenly to become in front of the vehicle approaching the traffic light, and such an event may impact the estimation as to how long it will take for the vehicle to reach the standstill at the traffic light. Accordingly, it may be understood that step 620 may not simply be determined one time in response to an indication that the vehicle is approaching the traffic light, but rather, may be continually updated as the vehicle is slowing to the standstill at the traffic light. It may be further understood that as the estimation of the duration of time it is inferred to take changes, downstream steps of method 600 may be adjusted accordingly. As such, a dotted line is depicted at 620 illustrating that step 620 may loop back on itself in order to provide an accurate determination as to the duration of time it is inferred to take for the vehicle to reach a standstill, taking into account changes in the rate at which the vehicle is decelerating. In some examples, traffic conditions may change such that the downstream method steps indicate that conditions are no longer met for proceeding with the diagnostic, at which point the diagnostic may be aborted.

With the time to reach a complete stop at the traffic light estimated at 620, method 600 may proceed to 625. At 625, method 600 may include estimating an amount of time it is expected to take to evacuate the fuel system and evaporative emissions system to a threshold vacuum (negative pressure with respect to atmospheric pressure). How long it may take to evacuate the fuel system and evaporative emissions system may be a function of at least fuel level in the fuel tank, level of intake manifold vacuum, and the threshold vacuum that is desired to be reached. For vehicles with sealed fuel tanks, the time it may take to evacuate the fuel system and evaporative emissions system may be further based on whether there is a negative pressure in the fuel sealed fuel system. For example, if there is already a standing negative pressure in the sealed fuel system, then the diagnostic may be conducted by taking advantage of the negative pressure already in the fuel system, which may decrease a time it may take to evacuate the fuel system and evaporative emissions system, as will be discussed in further detail below. Alternatively, if there is a positive pressure in the sealed fuel system, then the positive pressure may first have to be relieved prior to evacuating the fuel system and evaporative emissions system, and the time it may take to relieve the pressure may be factored into the estimate of how long it may take to evacuate the fuel system and evaporative emissions system, as will be further discussed below.

Thus, at 625, the controller may retrieve information related to intake manifold vacuum via the pressure sensor (e.g. 213) positioned in the intake manifold, and information related to fuel level via the fuel level indicator (e.g. 234). As changes in traffic conditions, lane changes of the vehicle, etc., may result in changes of the rate that the vehicle is decelerating (as discussed above), intake manifold vacuum may also change and thus the time it may take to evacuate the fuel system and evaporative emissions system may also change depending on vehicle operational conditions. Accordingly, a dashed line is depicted at 625 similar to that above at 620, illustrating that step 625 may loop back on itself to continually update the parameter that includes the estimated time it is expected to take to evacuate the fuel system and evaporative emissions system in order to conduct the evaporative emissions test diagnostic. Downstream method steps may be adjusted accordingly as the vehicle is slowing to a standstill.

Proceeding to 630, method 600 may include estimating or approximating a time that it will take, once the threshold vacuum has been established in the fuel system and evaporative emissions system, for a bleed-up portion of diagnostic. More specifically, as discussed above, for conducting the evaporative emissions test diagnostic, first the threshold vacuum may be established in the fuel system and evaporative emissions system. Once reached, the fuel system and evaporative emissions system may be sealed from atmosphere and engine intake, and pressure bleed-up may be monitored to assess a presence or absence of sources of undesired evaporative emissions. If the pressure remains below a threshold pressure and/or if a rate at which pressure bleeds up is less than a threshold pressure bleed-up rate, then an absence of undesired evaporative emissions may be indicated. However, the threshold pressure and/or the threshold pressure bleed-up rate may be a function of the diagnostic itself. For example, the evaporative emissions test diagnostic may assess whether the fuel system and evaporative emissions system are free from a source of undesired evaporative emissions 0.20" or greater. As another example, the evaporative emissions test diagnostic may assess whether the fuel system and evaporative emissions system are free from a source of undesired evaporative emissions 0.40" or greater. As yet another example, the evaporative emissions test diagnostic may assess whether the fuel system and evaporative emissions system are free from a source of undesired evaporative emissions 0.90" or greater. The bleed-up portion of the test for sources of undesired evaporative emissions 0.20" or greater may take a longer time than the test for 0.40" sources, which may take a longer time than the test for 0.90" sources of undesired evaporative emissions. The durations for each test may be stored in a lookup table at the controller of the vehicle. Thus, at 630, method 600 may include determining which test is requested, and then retrieving the duration of the particular test requested from a lookup table stored at the controller.

Once the duration of the bleed-up portion of the test has been determined at 630, method 600 may proceed to 635. At 635, method 600 may include determining a duration until the traffic light will again change to green. As discussed above, via V2I communications with the traffic light (the traffic light comprising a smart traffic light), the controller of the vehicle may retrieve information pertaining to when the traffic light will turn green. For example, the controller of the vehicle may request such information via wireless communication between the controller and the roadside unit (e.g. 430) associated with the traffic light. The roadside unit may receive the request, and may then send such information wirelessly back to the controller of the vehicle. In this way, an accurate determination of how long it may take for the light to again turn green may be obtained.

Proceeding to 640, method 600 may assess whether there is enough time to conduct the test or not, based on the variables determined with regard to steps 620, 625, 630 and 635. Specifically, the controller may first determine whether the estimated time it will take to evacuate the fuel system and evaporative emissions system is less than the estimated time it will take for the vehicle to come to a complete stop. Thus, it may be understood that for this particular diagnostic, the fuel system and evaporative emissions system are evacuated to the threshold vacuum while the vehicle is in motion, with the goal of reaching the threshold vacuum at the time that the vehicle comes to a complete stop. In other words, at a time coinciding with (e.g. within 1-2 seconds or less) the vehicle coming to a complete stop. In this way, time may be saved in conducting the diagnostic, as opposed to waiting to evacuate the fuel system and evaporative emissions system once the vehicle has stopped at the traffic light. Furthermore, such methodology may be advantageous for vehicles equipped with S/S capability, which may pull down or deactivate the engine when the vehicle comes to a stop.

At 640, method 600 may additionally assess whether the estimated time it will take for the vehicle to come to a stop (step 620) plus the estimated time it will take to conduct the pressure bleed-up portion of the test, is less than the estimated time it will take for the traffic light to turn green. In other words, it may be assessed as to whether there it is likely that the test will return results of the diagnostic prior to the light turning green, such that the test does not have to be aborted.

Thus, at 640, for method 600 to proceed with conducting the evaporative emissions test diagnostic, two conditions may have to be satisfied. First, the time to evacuate the fuel system and evaporative emissions system may have to be less than the estimated amount of time until the vehicle stops, such that the fuel system and evaporative emissions system may be evacuated to the threshold vacuum at the time coinciding with the vehicle stop event. Second, the estimated time until the vehicle stops plus the estimated time for the pressure bleed-up portion of the test may have to be less than time it will take for the light to turn green. If both conditions are not satisfied, then method 600 may proceed to 645, where current vehicle operating conditions are maintained without conducting the evaporative emissions test diagnostic. For example, the fuel system and evaporative emissions system may not be evacuated, and the vehicle may be propelled according to driver demand. Because a test for undesired evaporative emissions was requested, but because the particular traffic light was not conducive for conducting the test, another diagnostic may be scheduled for the current drive cycle. For example, the controller may assess whether another traffic light may be present along the route currently being traveled via the vehicle, and if so, another attempt may be made to conduct the test as the vehicle approaches the particular light or lights. Method 600 may then run again as the vehicle approaches another traffic light.

Returning to 640, if it is determined that the time to evacuate the fuel system and evaporative emissions system is expected to be less than the time it is expected to take for the vehicle to stop, and if the estimated time to stop plus the estimated duration of the pressure bleed-up portion of the test is less than the estimated time it will take for the light to change to green, method 600 may proceed to 650. At 650, method 600 may include sealing the fuel system and evaporative emissions system from atmosphere, and applying a vacuum on the fuel system and evaporative emissions system in order to establish the threshold vacuum in the fuel system and evaporative emissions system.

For a vehicle that has a sealed fuel tank, for example if the vehicle includes an FTIV (e.g. 291), then it may be determined as to whether there is a positive pressure with respect to atmospheric pressure or a negative pressure with respect to atmospheric pressure in the fuel tank. If the fuel tank is holding negative pressure, then at step 650 the CVV may be commanded closed, then the FTIV may be commanded open, and then the CPV may be duty cycled to apply intake manifold vacuum on the otherwise sealed fuel system and evaporative emissions system. In other words, because there is already a negative pressure in the fuel system and evaporative emissions system, the negative pressure may be advantageously utilized, which may decrease an overall time it may take to establish the threshold vacuum in the fuel system and evaporative emissions system.

Alternatively, if the fuel tank is holding a positive pressure with respect to atmospheric pressure, then at 650 the FTIV may first be commanded open to depressurize the fuel system, and once within a threshold of atmospheric pressure (e.g. not different from atmospheric pressure by more than 5%), the CVV may be commanded closed, and then the CPV may be duty cycled in order to apply engine intake manifold vacuum on the otherwise sealed fuel system and evaporative emissions system.

The CPV may be duty cycled as a function of the estimated time it will take for the vehicle to come to a complete stop, or in other words, when the change in vehicle speed over time is 0. Specifically, the CPV may be duty cycled such that the threshold vacuum is established in the fuel system and evaporative emissions system at the time when the vehicle stops. For example, if the threshold vacuum were established prior to the vehicle reaching a complete stop at the traffic light and in response to the threshold vacuum being established the CPV were closed, then pressure in the fuel system and evaporative emissions system may begin bleeding up prior to the vehicle stopping, and the act of stopping may result in fuel slosh which may complicate interpretation of the results of the bleed-up portion of the test. In a similar vein, if the threshold vacuum were not established by the time that the vehicle comes to a complete stop, then fuel slosh again may complicate the diagnostic, and furthermore, evacuating the fuel system and evaporative emissions system while the vehicle is stopped may increase a likelihood that the vehicle may stall. Still further, if the vehicle is a S/S vehicle where the engine is shut down at a vehicle stop, then there may not be a means for continuing to apply the vacuum on the fuel system and evaporative emissions system once the vehicle is stopped.

Accordingly, as the vehicle is coming to a stop with the CPV being duty cycled, the controller may continually update the estimated time it will take for the vehicle to stop (similar to that discussed at step 620), and the controller may regulate CPV duty cycle accordingly such that the threshold vacuum is reached at the time the vehicle comes to a complete stop. For example, the CPV duty cycle may initially begin at a 50% duty cycle, and as the threshold vacuum is approached in the fuel system and evaporative emissions system, the duty cycle may be lowered (e.g. to 30%, then to 20%, etc.) so as to ensure that the threshold vacuum is established at the time the vehicle stops, without overshooting the threshold vacuum. In another example, the CPV may be duty cycled at the 50% duty cycle, and then the duty cycle may be increased (e.g. to 60%, 70%, etc.) as the vehicle becomes closer to the complete stop, in order to ensure that the threshold vacuum is established at the time the vehicle stops. Such examples are meant to be illustrative, and are not meant to be limiting.

Accordingly, with the CPV being duty cycled at 650 to apply engine intake manifold vacuum on the otherwise sealed fuel system and evaporative emissions system, method 600 may proceed to 655. At 655, method 600 may include indicating whether the vehicle has come to a complete stop. If not, then the CPV may continue to be duty cycled as a function of estimated time it will take for the vehicle to stop at the light. Alternatively, at 655, in response to the vehicle coming to a stop at the traffic light, method 600 may proceed to 660. At 660, method 600 may include commanding closed the CPV to seal off the fuel system and evaporative emissions system from atmosphere. With the fuel system and evaporative emissions system sealed, pressure bleed-up in the fuel system and evaporative emissions system may be monitored. Pressure bleed-up may be compared to a threshold pressure bleed-up and/or a rate at which the pressure bleeds up may be compared to a threshold pressure bleed-up rate, as discussed above.

Accordingly, proceeding to 665, method 600 may include assessing whether pressure bleed-up in the fuel system and evaporative emissions system exceeds the threshold pressure bleed-up and/or if the rate at which the pressure is bleeding up exceeds (is faster than) the threshold pressure bleed-up rate. While not explicitly illustrated, as discussed above the pressure bleed-up portion of the test may be of a duration related to the particular test being conducted (e.g. whether the test if to determine if there is a source of undesired evaporative emissions greater than 0.20", greater than 0.40", etc.). If the particular duration elapses without pressure bleed-up exceeding the pressure bleed-up threshold and/or without the rate of pressure bleed-up exceeding the threshold pressure bleed-up rate, then method 600 may proceed to 670, where an absence of undesired evaporative emissions may be indicated. Alternatively, if pressure bleed-up exceeds the pressure bleed-up threshold and/or if the rate at which pressure bleeds up exceeds the threshold pressure bleed-up rate prior to the particular duration elapsing, then method 600 may proceed to 680 where the presence of undesired evaporative emissions stemming from the fuel system and/or evaporative emissions system may be indicated.

The results of such a test may be stored at the controller. For example, at 670, method 600 may include indicating the absence of undesired evaporative emissions, and may include storing the result at the controller. Alternatively, at 675, method 600 may include indicating the presence of undesired evaporative emissions, and may include storing the result at the controller. For example, a diagnostic trouble code (DTC) may be set at the controller pertaining to the source of undesired evaporative emissions. Whatever the result, method 600 may proceed to 680. At 680, method 600 may include updating vehicle operating conditions as a function of the results of the test diagnostic. For example, if the presence of undesired evaporative emissions is indicated, then at 680 method 600 may include illuminating a malfunction indicator light at the vehicle dash to alert a vehicle operator and/or customer/passenger of a request to service the vehicle. Furthermore, because a source of undesired evaporative emissions was indicated, a canister purge schedule may be updated such that the canister is purged more frequently than otherwise, which may route potential undesired evaporative emissions to engine intake for combustion rather than to atmosphere. In some examples where the presence of undesired evaporative emissions is indicated, the vehicle controller may update control strategy such that the vehicle is operated in an electric-only mode of operation as frequently as possible, which may result in less overall fuel vapor generation in the fuel system, which may reduce potential for such vapors to be released to the environment. Still further, in a case where the presence of undesired evaporative emissions is indicated, a schedule for conducting tests for presence or absence of undesired evaporative emissions may be updated, as it may not be desirable to continue to conduct such tests until the issue has been mitigated. Alternatively, in a case where the presence of undesired evaporative emissions is not indicated, updating vehicle operating may include maintaining the current evaporative emissions testing schedule, maintaining current purging schedules, maintaining current engine strategy, etc.

Furthermore, at 680, in response to the test results having been determined, method 600 may include unsealing the fuel system and evaporative emissions system, and in the case of vehicles that include an FTIV, the FTIV may be commanded closed once the fuel system and evaporative emissions system is depressurized. For example, with the fuel system and evaporative emissions system fludically coupled (FTIV open), the CVV may first be commanded open, such that pressure in the fuel system and evaporative emissions system may be relieved. Then, the FTIV may be commanded closed. Method 600 may then end.

While the above-described methodology for initiating and conducting the evaporative emissions test diagnostic relies on the engine for evacuating the fuel system and the evaporative emissions system, in another example rather than relying on the engine, a vacuum pump positioned in the evaporative emissions system may be used to evacuate the fuel system and the evaporative emissions system. For example, a vacuum pump may be positioned in the vent line (e.g. 227) between the canister and atmosphere. If the vehicle system includes such a vacuum pump, then there may be opportunity to evacuate the fuel system and the evaporative emissions system in order to conduct the evaporative emissions test diagnostic while the vehicle is operating in an electric-only mode of operation as the vehicle is decelerating to stop at a traffic light. For example, in response to the evaporative emissions test diagnostic being requested, and in further response to an indication that the test may be conducted such that the test provides results of the diagnostic prior to the traffic light that the vehicle is decelerating in order to stop at changing status (e.g. from red to green), the vacuum pump may be utilized in similar fashion as that discussed above in order to evacuate the fuel system and the evaporative emissions system to the threshold negative pressure. In such an example, the fuel system and the evaporative emissions system may be fluidically coupled (e.g. FTIV commanded open), and the fuel system and the evaporative emissions system may be sealed off from the engine during the evacuation. The CVV may be commanded open during the evacuating via the vacuum pump, and then the CVV may be commanded closed responsive to the threshold negative pressure being reached. In order to ensure that the threshold negative pressure is reached at a time coinciding with the time that the vehicle stops, pump speed may be controlled. In the case of a potential overshoot of the negative pressure threshold via the vacuum pump, then the CPV may be commanded open and duty cycle controlled to relieve the vacuum, such that the threshold negative pressure may be established in the fuel system and the evaporative emissions system at the time coinciding with the vehicle coming to a stop at the traffic light.

Thus, a method may comprise adjusting evacuation of a fuel system and an evaporative emissions system of a vehicle in order to conduct a test for a presence or an absence of undesired evaporative emissions stemming from the fuel system and/or the evaporative emissions system, in response to a status of a traffic light that the vehicle is approaching.

In such a method, adjusting evacuation of the fuel system and the evaporative emissions system may include evacuating the fuel system and the evaporative emissions system via a negative pressure with respect to atmospheric pressure that is communicated to the fuel system and the evaporative emissions system from an intake manifold of an engine. In another example, adjusting evacuation of the fuel system and the evaporative emissions system may include evacuating the fuel system and the evaporative emissions system via a pump positioned in the evaporative emissions system.

In such a method, adjusting evacuation in order to conduct the test for the presence or the absence of undesired evaporative emissions in response to the status of the traffic light may further comprise retrieving the status of the traffic light via wireless communication between a controller of the vehicle and a roadside unit corresponding to the traffic light.

In such a method, adjusting evacuation of the fuel system and the evaporative emissions system in response to the status of the traffic light that the vehicle is approaching may further comprise initiating evacuation of the fuel system and the evaporative emissions system in response to a determination that it is predicted that the test for the presence or the absence of undesired evaporative emissions will be able to provide results of the test prior without the test being aborted, based on the status of the traffic light.

In such a method, adjusting evacuation of the fuel system and the evaporative emissions system may further comprise controlling evacuation of the fuel system and the evaporative emissions system in order to reach a threshold negative pressure in the fuel system and the evaporative emissions system at a time that coincides with the vehicle coming to a stop at the traffic light. In an example, in response to the threshold negative pressure being reached in the fuel system and the evaporative emissions system at the time that coincides with the vehicle coming to the stop at the traffic light, the method may include sealing the fuel system and the evaporative emissions system and monitoring a pressure bleed-up in the fuel system and evaporative emissions system to indicate the presence or absence of undesired evaporative emissions stemming from the fuel system and/or the evaporative emissions system, while the vehicle is stopped at the traffic light.

Furthermore, such a method may include maintaining current vehicle operating conditions without adjusting evacuation of the fuel system and the evaporative emissions system in response to an indication that the vehicle is predicted to pass through the traffic light without stopping.

Another method may comprise, in response to a vehicle decelerating in order to stop at a traffic light, initiating a test for indicating a presence or an absence of undesired evaporative emissions stemming from a fuel system and/or an evaporative emissions system of the vehicle based on a prediction that the test is expected to provide results prior to the traffic light changing status from a request to stop (e.g. a request for the vehicle to stop) to a request to proceed through the traffic light (e.g. a request for the vehicle to proceed through the traffic light).

In such a method, the traffic light may comprise a smart traffic light that includes a roadside unit capable of communicating information pertaining to the traffic light status to a controller of the vehicle. Under circumstances where the test is initiated and the traffic light changes status from the request to stop to the request to proceed through the traffic light prior to the test providing results, the test may be aborted.

In such a method, the test may include evacuating the fuel system and the evaporative emissions system to a threshold negative pressure as the vehicle is decelerating so that the threshold negative pressure is reached at a time coinciding (e.g. within 1-2 seconds or less) with the vehicle stopping at the traffic light. The method may further include sealing the fuel system and the evaporative emissions system at the time coinciding with the vehicle stopping at the traffic light, and may still further include monitoring a pressure bleed-up in the fuel system and the evaporative emissions system to indicate the presence or the absence of undesired evaporative emissions.

In such a method, the method may include controlling a rate at which the fuel system and the evaporative emissions system are evacuated in order to reach the threshold negative pressure at the time coinciding with the vehicle stopping at the traffic light.

In such a method, the prediction may be a function of an estimate of a first duration of time it is expected to take for the vehicle to stop at the traffic light, an estimate of a second duration of time it is expected to take to evacuate the fuel system and the evaporative emissions system to the threshold negative pressure, and an indication of a third duration of time that it is expected to take to monitor the pressure bleed-up.

In such a method, in response to an indication that the test may not provide results prior to the traffic light changing status, the method may include scheduling the test for another traffic light along a route that the vehicle is traveling to a destination. In some examples, the route that the vehicle is traveling may comprise a learned route, or may comprise a route selected via a vehicle operator or passenger (or in some cases selected via a controller of an autonomous vehicle), via an onboard navigation system.

Turning now to FIG. 7, an example timeline 700 depicting how an evaporative emissions test diagnostic may be conducted according to the method of FIG. 6, is shown. Timeline 700 includes plot 705 indicating whether an evaporative emissions test diagnostic is requested (yes) or not (no), over time. Timeline 700 further includes plot 710, indicating vehicle speed, over time. The vehicle may be stopped (0), or may be at a traveling at a speed greater (+) than stopped. Timeline 700 further includes plot 715, indicating pressure in the fuel system and evaporative emissions system, over time. Timeline 700 further includes plot 720, indicating a status of the CPV (e.g. 261), plot 725, indicating a status of the CVV (e.g. 297), and plot 730, indicating a status of the FTIV (e.g. 291), over time. For each of the CPV, CVV and FTIV, the valves may either be open or closed, over time. Timeline 700 further includes plot 735, indicating whether it is determined (yes, no, or not-applicable) that the evaporative emissions test diagnostic may provide results of the test prior to a traffic light that the vehicle is approaching/stopped at turning green. Timeline 700 further includes plot 740, indicating whether there is a presence or an absence of undesired evaporative emissions (yes or no) stemming from the fuel system and/or evaporative emissions system, over time. Timeline 700 further includes plot 745, indicating traffic light status, over time. In this example the traffic light may be either green, or red.

At time t0, the vehicle is in motion (plot 710), and while not explicitly illustrated, it may be understood that the vehicle is being propelled at least in part via the engine. In other words, the engine is combusting air and fuel. An evaporative emissions test is requested for the fuel system and evaporative emissions system (plot 705). The CVV is open (plot 725), the CPV is closed (plot 720), and the FTIV is closed (plot 730). Pressure in the fuel system and evaporative emissions system is near atmospheric pressure. For example, because the CVV is open, the evaporative emissions system is coupled to atmosphere, thus the evaporative emissions system is near atmospheric pressure. Furthermore, in this example timeline the fuel system, although sealed, is near atmospheric pressure. That the fuel system is near atmospheric pressure may be indicative of a source of undesired evaporative emissions stemming from the fuel system, as with the fuel system sealed and with the vehicle in motion along with the engine combusting air and fuel, it may be otherwise expected that the fuel system may be at a positive pressure with respect to atmospheric pressure. At time to, the vehicle has not started slowing in anticipating of approaching a traffic light (plot 710), and currently the traffic light the vehicle is approaching is green (plot 745). Accordingly, at time t0 whether the time it is expected to take to conduct the test for presence or absence of undesired evapforative emissions is less than the time it takes for the light to change to green, is not yet applicable (plot 745).

At time t1, the traffic light that the vehicle is approaching switches red (plot 745). Accordingly, the vehicle begins decelerating in order to stop at the traffic light (plot 710). Between time t1 and t2, the vehicle controller estimates, based on current traffic conditions and rate of deceleration of the vehicle, how long it will take for the vehicle to reach a complete stop (see step 620 of method 600). Furthermore, between time t1 and t2, the vehicle controller estimates how long it is expected to take to evacuate the fuel system and evaporative emissions system to the threshold vacuum in order to conduct the evaporative emissions test diagnostic (see step 625 of method 600). As discussed, such an estimate may be based at least on the level of intake manifold vacuum and fuel level in the fuel tank. Still further, between time t1 and t2, the controller retrieves information pertaining to what type of evaporative emissions test diagnostic is requested, for example a test to determine whether the fuel system and evaporative emissions system is free from a source of undesired evaporative emissions greater than 0.20", 0.40", or 0.90" (see step 630 of method 600). Depending on what particular test is requested, the vehicle controller may query a lookup table to determine an estimate of how much time the pressure bleed-up portion of such a test may take. In other words, the pressure bleed-up portion duration may be variable as a function of the test being conducted. Finally, between time t1 and t2, the vehicle controller may send a request via V2I communications to a road-side unit of the traffic light that the vehicle is approaching, in order to retrieve information pertaining to how long the traffic light is going to stay red, or in other words, how long until the traffic light changes to green. In some examples, the vehicle controller may additionally or alternatively communicate with one or more vehicles via V2V communications, such that information pertaining to how long the light is expected to stay red may be ascertained. For example, other vehicles that have stopped at the same light and/or have communicated via V2I communications with said light, may have information pertaining to the duration that the light stays red/green stored at their particular controllers. Such information may be useful to the vehicle approaching the traffic light in order to make a determination as to whether the evaporative emissions test diagnostic may be conducted (with results provided) prior to the light changing.

More specifically, as discussed above at step 640, the above-mentioned durations determined by the vehicle controller may be used to assess whether both 1) a condition that the time it is estimated to take to evacuate the fuel system and evaporative emissions system is less than the time estimate for the vehicle to stop, and 2) a condition that the time estimated for the vehicle to stop plus the duration for the particular bleed-up test is less than the time it is expected to take for the light to change to green, are satisfied. In this example timeline, at time t2, both conditions are indicated to be satisfied, and thus, it is indicated that the time it is inferred to take to conduct the test is less than the time it is expected to take for the light to change to green (plot 735). Accordingly, the test diagnostic is initiated at time t3.

Specifically, at time t3 the FTIV is commanded open (plot 730), the CVV is commanded closed (plot 725), and the CPV is commenced being duty cycled at a first duty cycle. Said another way, the fuel system is fluidically coupled to the evaporative emissions system via the commanding open of the FTIV, and the fuel system and evaporative emissions system is sealed from atmosphere via the commanding closed of the CVV. By duty cycling the CPV, intake manifold vacuum is applied on the sealed fuel system and evaporative emissions system. Accordingly, between time t3 and t4, pressure in the fuel system and evaporative emissions system decreases, or in other words, becomes negative with respect to atmospheric pressure (plot 715).

At time t4, as pressure in the fuel system and evaporative emissions system approaches the threshold vacuum, represented by dashed line 716, the controller determines that in order to ensure that the threshold vacuum is reached at the same time (e.g. within 1-2 seconds or less) as the vehicle comes to a complete stop, the duty cycle is modified to a lower duty cycle. If the duty cycle were not modified at time t4, then the threshold vacuum may have been reached prior to the vehicle stopping at the traffic light, which may not be desirable as in such a case, pressure bleed-up analysis may be complicated as discussed above.

At time t5, the vehicle stops at the traffic light (plot 710), as vehicle speed is indicated to be 0 (miles per hour, for example), as represented by dashed line 711. Accordingly, the CPV is commanded closed (plot 720). With the CPV commanded closed, pressure in the sealed fuel system and evaporative emissions system is monitored. Specifically, pressure bleed-up is monitored and compared to a pressure bleed-up threshold, represented by dashed line 717. While not explicitly illustrated, in other examples pressure bleed-up rate may be monitored and compared to a threshold pressure bleed-up rate. In this example, the pressure bleed-up threshold as represented by dashed line 717 is set as a function of the size of the source of undesired evaporative emissions that the test is attempting to diagnose. For illustrative purposes, the pressure bleed-up threshold 717 is set so as to indicate that the fuel system and evaporative emissions system is free from a source of undesired evaporative emissions of a diameter of 0.20" if pressure bleed-up remains below the pressure bleed-up threshold 717 for the duration of time that the pressure bleed-up portion of the test is set.

However, in this example timeline 700, pressure in the fuel system and evaporative emissions system reaches the pressure bleed-up threshold at time t6, prior to the time allowed for the test elapsing (not shown). Thus, because the pressure bleed-up threshold was reached, the presence of a source of undesired evaporative emissions is indicated (plot 740). With the presence of undesired evaporative emissions indicated at time t6, and thus, as the test results have been provided, the test for evaporative emissions is no longer requested (plot 705). It is also no longer applicable as to whether the time it will take to conduct the test and return results is less than the time it will take for the light to change to green (plot 735).

With the results having been obtained at time t6, the CVV is commanded open (plot 725), such that the fuel system and evaporative emissions system is coupled to atmosphere. In this way, pressure in the fuel system and evaporative emissions system may be relieved, and accordingly, between time t6 and t7 pressure in the fuel system and evaporative emissions system returns to atmospheric pressure (plot 715). With pressure in the fuel system and evaporative emissions system having returned to atmospheric pressure, the FTIV is commanded closed at time t7.

At time t8, the traffic light turns green (plot 745) and as such, the vehicle is requested to be propelled from the stopped position. Accordingly, vehicle speed increases after time t8.

In this way, tests for presence or absence of undesired evaporative emissions that rely on engine manifold vacuum to evacuate the fuel system and evaporative emissions system may be conducted under circumstances where it is highly likely based on a number of determined variables, that the test is expected to be able to provide results prior to circumstances changing that may result in the test being aborted. In this way, completion rates may improve for tests for presence or absence of undesired evaporative emissions, release of undesired evaporative emissions to atmosphere may be reduced, and customer satisfaction may be improved.

The technical effect is to recognize that by leveraging information obtained from smart traffic lights, a vehicle controller may make a determination as to whether or not to initiate a test for presence or absence of undesired evaporative emissions, based on a likelihood that the test will return results without having to be aborted. Specifically, a technical effect is to recognize that V2I and in some examples, V2V, communications may be utilized to determine whether a traffic light that the vehicle is approaching may comprise a suitable vehicle-stop event to enable a test for undesired evaporative emissions to be conducted, with a high likelihood that the test will return results prior to the vehicle being requested to be propelled in response to the light turning green. A further technical effect is to recognize that a portion of the test that comprises the fuel system and evaporative emissions system evacuation phase may be conducted prior to the vehicle stopping at the traffic light where the pressure bleed-up portion of the test may be conducted. By evacuating the fuel system and evaporative emissions system prior to the vehicle stopping, the pressure bleed-up portion of the test may be executed sooner (right after the vehicle stops) as opposed to first stopping the vehicle, then evacuating the fuel system and evaporative emissions system, and next conducting the pressure bleed-up portion of the test.

A still further technical effect is to recognize that it may be advantageous to conduct the evacuation phase of the evaporative emissions test such that the threshold vacuum for conducting the test is reached at the same time (within 1-2 seconds or less) as the vehicle comes to a stop where vehicle speed is 0 (miles per hour for example). In this way, the pressure bleed-up portion of the test may commence right after the vehicle stops, rather than starting prior to the stop, which may improve interpretation of the pressure bleed-up analysis. Still further, reaching the threshold vacuum at the same time the vehicle stops may avoid having to evacuate the fuel system and evaporative emissions system while the vehicle is stopped and idling, which may stall the vehicle. In addition, for vehicles equipped with start/stop capability, evacuating the fuel system and evaporative emissions system to reach the threshold vacuum at the same time as the vehicle stops may be advantageous as the engine may not even be available after the vehicle stops for evacuating the fuel system and evaporative emissions system.

The systems discussed herein, and with regards to FIGS. 1-4, along with the methods described herein, and with regard to FIGS. 5-6, may enable one or more systems and one or more methods. In one example, a method comprises adjusting evacuation of a fuel system and an evaporative emissions system of a vehicle in order to conduct a test for a presence or an absence of undesired evaporative emissions stemming from the fuel system and/or the evaporative emissions system, in response to a status of a traffic light that the vehicle is approaching. In a first example of the method, the method further includes wherein adjusting evacuation of the fuel system and the evaporative emissions system includes evacuating the fuel system and the evaporative emissions system via a negative pressure with respect to atmospheric pressure that is communicated to the fuel system and the evaporative emissions system from an intake manifold of an engine. A second example of the method optionally includes the first example, and further includes wherein adjusting evacuation of the fuel system and the evaporative emissions system includes evacuating the fuel system and the evaporative emissions system via a pump positioned in the evaporative emissions system. A third example of the method optionally includes any one or more or each of the first through second examples, and further includes wherein adjusting evacuation in order to conduct the test for the presence or the absence of undesired evaporative emissions further comprises: retrieving the status of the traffic light via wireless communication between a controller of the vehicle and a roadside unit corresponding to the traffic light. A fourth example of the method optionally includes any one or more or each of the first through third examples, and further includes wherein adjusting evacuation of the fuel system and the evaporative emissions system in response to the status of the traffic light that the vehicle is approaching further comprises: initiating evacuation of the fuel system and the evaporative emissions system in response to a determination that it is predicted that the test for the presence or the absence of undesired evaporative emissions will be able to provide results of the test prior without the test being aborted, based on the status of the traffic light. A fifth example of the method optionally includes any one or more or each of the first through fourth examples, and further includes wherein adjusting evacuation of the fuel system and the evaporative emissions system further comprises controlling evacuation of the fuel system and the evaporative emissions system in order to reach a threshold negative pressure in the fuel system and the evaporative emissions system at a time that coincides with the vehicle coming to a stop at the traffic light. A sixth example of the method optionally includes any one or more or each of the first through fifth examples, and further comprises in response to the threshold negative pressure being reached in the fuel system and the evaporative emissions system at the time that coincides with the vehicle coming to the stop at the traffic light, sealing the fuel system and the evaporative emissions system and monitoring a pressure bleed-up in the fuel system and evaporative emissions system to indicate the presence or absence of undesired evaporative emissions stemming from the fuel system and/or the evaporative emissions system, while the vehicle is stopped at the traffic light. A seventh example of the method optionally includes any one or more or each of the first through sixth examples, and further comprises maintaining current vehicle operating conditions without adjusting evacuation of the fuel system and the evaporative emissions system in response to an indication that the vehicle is predicted to pass through the traffic light without stopping.

Another example of a method comprises in response to a vehicle decelerating in order to stop at a traffic light, initiating a test for indicating a presence or an absence of undesired evaporative emissions stemming from a fuel system and/or an evaporative emissions system of the vehicle based on a prediction that the test will provide results prior to the traffic light changing status from a request to stop to a request to proceed through the traffic light. In a first example of the method, the method further includes wherein the traffic light comprises a smart traffic light that includes a roadside unit capable of communicating information pertaining to the traffic light status to a controller of the vehicle. A second example of the method optionally includes the first example, and further includes wherein under circumstances where the test is initiated and the traffic light changes status from the request to stop to the request to proceed through the traffic light prior to the test providing results, the test is aborted. A third example of the method optionally includes any one or more or each of the first through second examples, and further includes wherein the test includes evacuating the fuel system and the evaporative emissions system to a threshold negative pressure as the vehicle is decelerating so that the threshold negative pressure is reached at a time coinciding with the vehicle stopping at the traffic light; and sealing the fuel system and the evaporative emissions system at the time coinciding with the vehicle stopping at the traffic light and monitoring a pressure bleed-up in the fuel system and the evaporative emissions system to indicate the presence or the absence of undesired evaporative emissions. A fourth example of the method optionally includes any one or more or each of the first through third examples, and further comprises controlling a rate at which the fuel system and the evaporative emissions system is evacuated in order to reach the threshold negative pressure at the time coinciding with the vehicle stopping at the traffic light. A fifth example of the method optionally includes any one or more or each of the first through fourth examples, and further includes wherein the prediction is a function of an estimate of a first duration of time it is expected to take for the vehicle to stop at the traffic light, an estimate of a second duration of time it is expected to take to evacuate the fuel system and the evaporative emissions system to the threshold negative pressure, and an indication of a third duration of time it is expected to take to monitor the pressure bleed-up. A sixth example of the method optionally includes any one or more or each of the first through fifth examples, and further comprises in response to an indication that the test will not provide results prior to the traffic light changing status, scheduling the test for another traffic light along a route that the vehicle is traveling to a destination. A seventh example of the method optionally includes any one or more or each of the first through sixth examples, and further includes wherein the route that the vehicle is traveling comprises a learned route, or where the route is selected via an onboard navigation system.

An example of a system for a vehicle comprises a fuel system selectively fluidically coupled to an evaporative emissions system that is selectively fluidically coupled to an engine and to atmosphere; and a controller with computer readable instructions stored on non-transitory memory that when executed, cause the controller to: in response to the vehicle decelerating in order to stop at a traffic light, send a wireless request to a roadside unit corresponding to the traffic light, the request including information pertaining to a status of the traffic light; wirelessly receive the information pertaining to the status of the traffic light from the roadside unit; and commence initiation of a test to determine a presence or an absence of a source of undesired evaporative emissions stemming the fuel system and/or the evaporative emissions system in response to a prediction that the fuel system and the evaporative emissions system will be evacuated to a threshold negative pressure while the vehicle is decelerating to stop at the traffic light, and in further response to an indication that a pressure bleed-up portion of the test that is conducted while the vehicle is stopped at the traffic light will provide results prior to the traffic light changing status from red to green. In a first example of the system, the system further includes wherein a canister purge valve selectively fluidically couples the evaporative emissions system to the engine; and wherein the controller stores further instructions to control a duty cycle of the canister purge valve in order to evacuate the fuel system and the evaporative emissions system to the threshold negative pressure at a time coinciding with the vehicle stopping at the light, where controlling the duty cycle of the canister purge valve regulates an amount of vacuum that is communicated from the engine to the fuel system and the evaporative emissions system. A second example of the system optionally includes the first example, and further comprises a fuel tank isolation valve that selectively fluidically couples the fuel system to the evaporative emissions system; a canister vent valve that selectively fluidically couples the evaporative emissions system to atmosphere; and wherein the controller stores further instructions to command open the fuel tank isolation valve and command closed the canister vent valve for evacuating the fuel system and the evaporative emissions system to the threshold negative pressure, and wherein in response to the vehicle stopping at the traffic light, the fuel tank isolation valve is maintained open, the canister vent valve is maintained closed, and the canister purge valve is commanded closed to seal the fuel system and the evaporative emissions system in order to conduct the pressure bleed-up portion of the test. A third example of the system optionally includes any one or more or each of the first through second examples, and further includes wherein the controller stores further instructions to determine a duration of time for conducting the pressure bleed-up portion of the test as a function of a diameter of the source of undesired evaporative emissions that the test diagnostic is testing for, in order to indicate that the pressure bleed-up portion of the test that is conducted while the vehicle is stopped at the traffic light will provide results prior to the traffic light changing status from red to green.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

adjusting evacuation of a fuel system and an evaporative emissions system of a vehicle during vehicle travel in order to conduct a test for a presence or an absence of undesired evaporative emissions stemming from the fuel system and/or the evaporative emissions system, in response to a status of a traffic light that the vehicle is approaching, including adjusting responsive to a time to reach stopped and a time to bleed-up the fuel system compared with a time predicted for a status change of the traffic light and further based on a time to evacuate the fuel system compared with the time to reach stopped.

2. The method of claim 1, wherein adjusting evacuation of the fuel system and the evaporative emissions system includes evacuating the fuel system and the evaporative emissions system via a negative pressure with respect to atmospheric pressure that is communicated to the fuel system and the evaporative emissions system from an intake manifold of an engine.

3. The method of claim 1, wherein adjusting evacuation of the fuel system and the evaporative emissions system includes evacuating the fuel system and the evaporative emissions system via a pump positioned in the evaporative emissions system.

4. The method of claim 1, wherein adjusting evacuation in order to conduct the test for the presence or the absence of undesired evaporative emissions further comprises:

retrieving the status of the traffic light via wireless communication between a controller of the vehicle and a roadside unit corresponding to the traffic light.

5. The method of claim 1, wherein adjusting evacuation of the fuel system and the evaporative emissions system in response to the status of the traffic light that the vehicle is approaching further comprises:

initiating evacuation of the fuel system and the evaporative emissions system in response to a determination that it is predicted that the test for the presence or the absence of undesired evaporative emissions will be able to provide results of the test prior to the traffic light changing status without the test being aborted, based on the status of the traffic light.

6. The method of claim 1, wherein adjusting evacuation of the fuel system and the evaporative emissions system further comprises controlling evacuation of the fuel system and the evaporative emissions system in order to reach a threshold negative pressure in the fuel system and the evaporative emissions system at a time that coincides with the vehicle coming to a stop at the traffic light.

7. The method of claim 6, further comprising:

in response to the threshold negative pressure being reached in the fuel system and the evaporative emissions system at the time that coincides with the vehicle coming to the stop at the traffic light, sealing the fuel system and the evaporative emissions system and monitoring a pressure bleed-up in the fuel system and evaporative emissions system to indicate the presence or the absence of undesired evaporative emissions stemming from the fuel system and/or the evaporative emissions system, while the vehicle is stopped at the traffic light.

8. The method of claim 1, further comprising:

maintaining current vehicle operating conditions without adjusting evacuation of the fuel system and the evaporative emissions system in response to an indication that the vehicle is predicted to pass through the traffic light without stopping.

9. A method comprising:

in response to a vehicle decelerating in order to stop at a traffic light, and while the vehicle is still traveling, initiating a test for indicating a presence or an absence of undesired evaporative emissions stemming from a fuel system and/or an evaporative emissions system of the vehicle based on a prediction that the test will provide results prior to the traffic light changing status from a request to stop to a request to proceed through the traffic light, the prediction based on a time to reach stopped and a time to bleed-up compared with a time for the request to proceed and further based on a time to evacuate the fuel system compared with the time to reach stopped.

10. The method of claim 9, wherein the traffic light comprises a smart traffic light that includes a roadside unit capable of communicating information pertaining to the traffic light status to a controller of the vehicle.

11. The method of claim 9, wherein, under circumstances where the test is initiated and the traffic light changes status from the request to stop to the request to proceed through the traffic light prior to the test providing results, the test is aborted.

12. The method of claim 9, wherein the test includes evacuating the fuel system and the evaporative emissions system to a threshold negative pressure as the vehicle is decelerating so that the threshold negative pressure is reached at a time coinciding with the vehicle stopping at the traffic light; and sealing the fuel system and the evaporative emissions system at the time coinciding with the vehicle stopping at the traffic light and monitoring a pressure bleed-up in the fuel system and the evaporative emissions system to indicate the presence or the absence of undesired evaporative emissions.

13. The method of claim 12, further comprising controlling a rate at which the fuel system and the evaporative emissions system is evacuated in order to reach the threshold negative pressure at the time coinciding with the vehicle stopping at the traffic light.

14. The method of claim 12, wherein the prediction is a function of an estimate of a first duration of time it is expected to take for the vehicle to stop at the traffic light, an estimate of a second duration of time it is expected to take to evacuate the fuel system and the evaporative emissions system to the threshold negative pressure, and an indication of a third duration of time it is expected to take to monitor the pressure bleed-up.

15. The method of claim 9, further comprising:

in response to an indication that the test will not provide results prior to the traffic light changing status, scheduling the test for another traffic light along a route that the vehicle is traveling to a destination.

16. The method of claim 15, wherein the route that the vehicle is traveling comprises a learned route, or wherein the route is selected via an onboard navigation system.

17. A system for a vehicle, comprising:

a fuel system selectively fluidically coupled to an evaporative emissions system that is selectively fluidically coupled to an engine and to atmosphere; and a controller with computer readable instructions stored on non-transitory memory that, when executed, cause the controller to:

in response to the vehicle decelerating in order to stop at a traffic light, send a wireless request to a roadside unit corresponding to the traffic light, the request including information pertaining to a status of the traffic light;

wirelessly receive the information pertaining to the status of the traffic light from the roadside unit; and commence initiation of a test to determine a presence or an absence of a source of undesired evaporative emissions stemming from the fuel system and/or the evaporative emissions system in response to a prediction that the fuel system and the evaporative emissions system will be evacuated to a threshold negative pressure while the vehicle is decelerating to stop at the traffic light, and in further response to an indication that a pressure bleed-up portion of the test that is conducted while the vehicle is stopped at the traffic light will provide results prior to the traffic light changing status from red to green; wherein the controller stores further instructions to determine a duration of time for conducting the pressure bleed-up portion of the test as a function of a diameter of the source of undesired evaporative emissions that a test diagnostic is testing for, in order to indicate that the pressure bleed-up portion of the test that is conducted while the vehicle is stopped at the traffic light will provide results prior to the traffic light changing status from red to green.

18. The system of claim 17, wherein a canister purge valve selectively fluidically couples the evaporative emissions system to the engine; and wherein the controller stores further instructions to control a duty cycle of the canister purge valve in order to evacuate the fuel system and the evaporative emissions system to the threshold negative pressure at a time coinciding with the vehicle stopping at the traffic light, where controlling the duty cycle of the canister purge valve regulates an amount of vacuum that is communicated from the engine to the fuel system and the evaporative emissions system.

19. The system of claim 18, further comprising:

a fuel tank isolation valve that selectively fluidically couples the fuel system to the evaporative emissions system; and a canister vent valve that selectively fluidically couples the evaporative emissions system to atmosphere;

wherein the controller stores further instructions to command open the fuel tank isolation valve and command closed the canister vent valve for evacuating the fuel system and the evaporative emissions system to the threshold negative pressure, and wherein, in response to the vehicle stopping at the traffic light, the fuel tank isolation valve is maintained open, the canister vent valve is maintained closed, and the canister purge valve is commanded closed to seal the fuel system and the evaporative emissions system in order to conduct the pressure bleed-up portion of the test.

* * * * *